US005871880A

United States Patent [19]

Makuta et al.

[11] Patent Number: 5,871,880

[45] **Date of Patent: *Feb. 16, 1999**

[54] SILVER HALIDE COLOR PHOTOGRAPHIC LIGHT-SENSITIVE MATERIAL AND IMAGE-FORMING METHOD

[75] Inventors: Toshiyuki Makuta; Koki Nakamura, both of Minami-ashigara, Japan

[73] Assignee: Fuji Photo Film Co., Ltd., Kanagawa-ken, Japan

[ * ] Notice: The term of this patent shall not extend beyond the expiration date of Pat. No. 5,780,210.

[21] Appl. No.: 753,507

[22] Filed: Nov. 26, 1996

[30] Foreign Application Priority Data

Nov. 30, 1995 [JP] Japan ..... 7-334201

[51] Int. Cl.[6] ..... G03C 7/413; G03C 8/10

[52] U.S. Cl. ..... 430/218; 430/226; 430/241; 430/371; 430/380; 430/483; 430/484; 430/467; 430/543; 430/545; 430/566; 430/941

[58] Field of Search ..... 430/218, 226, 430/380, 467, 371, 483, 484, 361, 359, 264, 543, 545, 941, 566, 241

[56] References Cited

U.S. PATENT DOCUMENTS

| | | | |
|---|---|---|---|
| 2,507,114 | 5/1950 | McQueen | 260/509 |
| 3,227,552 | 1/1966 | Whitmore | 430/226 |
| 3,764,328 | 10/1973 | Birkeland | 430/351 |
| 3,782,949 | 1/1974 | Olivares et al. | 430/218 |
| 4,060,418 | 11/1977 | Waxman et al. | 430/218 |
| 4,481,268 | 11/1984 | Bailey et al. | 430/380 |
| 5,667,945 | 9/1997 | Takeuchi et al. | 420/264 |
| 5,672,466 | 9/1997 | Okamura et al. | 430/467 |

FOREIGN PATENT DOCUMENTS

| | | |
|---|---|---|
| 0 545 491 A1 | 6/1993 | European Pat. Off. . |
| 0 565 165 A1 | 10/1993 | European Pat. Off. . |

*Primary Examiner*—Richard L. Schilling
*Attorney, Agent, or Firm*—Birch, Stewart, Kolasch & Birch, LLP

[57] ABSTRACT

There is disclosed a silver halide color photographic light-sensitive material having at least one photographic constitutional layer coated on a support, wherein at least one of the photographic constitutional layers contains at least one reducing agent for color formation represented by formula (I), at least one coupler for forming a diffusive dye, and at least one mordant. The material is capable of reducing the amount of developer and to be replenished or discharged after processing, and of reducing the occurrence of stain after development during storage of the material. There is also disclosed an image-forming method using the material.

Q C α-NHNH−Z Formula (I)

wherein Cα represents a carbon atom; Z represents a carbamoyl, acyl, alkoxycarbonyl, or aryloxycarbonyl group; and Q represents a group of atoms to form, together with Cα, an unsaturated ring.

18 Claims, No Drawings

SILVER HALIDE COLOR PHOTOGRAPHIC LIGHT-SENSITIVE MATERIAL AND IMAGE-FORMING METHOD

FIELD OF THE INVENTION

The present invention relates to an image-forming technique for use in color photography. In particular, the present invention relates to a silver halide color photographic light-sensitive material that is excellent from the standpoint of environmental protection and safety; that is excellent in convenient and rapid processability; that shows good color-forming property and hue; and that has reduced stains occurring after treatment; and further the present invention relates to a method of forming a color image.

BACKGROUND OF THE INVENTION

Generally, when a color photographic light-sensitive material is exposed to light image-wise and then color-developed, the oxidized p-phenylenediamine derivative reacts with couplers to form an image. In this system, color reproduction by the subtractive color technique is used, and, to reproduce blue, green, and red colors, dye images are formed that are yellow, magenta, and cyan in color, respectively complementary to blue, green, and red.

Color development is achieved by immersing a light-exposed color photographic light-sensitive material in an aqueous alkali solution having a p-phenylenediamine derivative dissolved therein (a color developer). However, there is a problem that the p-phenylenediamine derivative in an aqueous alkali solution is unstable and is apt to deteriorate over time, and in order to retain stable development performance, the color developer must be replenished frequently. Further, the disposal of used color developers containing a p-phenylenediamine derivative is burdensome, and together with the above frequent replenishment, the treatment of used color developers discharged in large quantities gives rise to a serious problem. Thus, there is a strong demand for the attainment of low replenishment and reduced discharge of color developers.

One effective measure proposed for attaining low replenishment and reduced discharge of color developers is a method wherein an aromatic primary amine developing agent or its precursor is built in a hydrophilic colloid layer of a light-sensitive material, and examples of the aromatic primary amine developing agents or their precursors that can be built in include compounds described, for example, in U.S. Pat. Nos. 2,507,114, 3,764,328, and 4,060,418, and JP-A ("JP-A" means unexamined published Japanese patent application) Nos. 6235/1981 and 192031/1983. However, since these aromatic primary amine developing agents and their precursors are unstable, there is the defect that, when the unprocessed light-sensitive material is stored for a long period of time or is color-developed, stain occurs. Another effective measure proposed is a method wherein a sulfonylhydrazine-type compound, as described, for example, in European Patent Nos. 0545491A1 and 565165A1, is built in a hydrophilic colloid layer of a light-sensitive material. However, the sulfonylhydrazine-type compounds listed therein still cannot attain satisfactory color density when chromogenically developed, and there is the problem that, when the sulfonylhydrazine-type compound is used with a two-equivalent coupler, the color formation is little. In comparison with four-equivalent couplers, two-equivalent couplers have such merits that stain originating in the couplers can be reduced, the activity of the couplers is easily adjusted, and coupling split-off groups in couplers can be allowed to have various functions. It is desired to develop a technique that can utilize these merits.

On the other hand, a dye obtained from a hydrazine compound, such as a carbamoyl hydrazine compound, and a dye-forming coupler is a dissociating-type dye that dissociates to form color. Therefore, color images cannot be obtained unless the dye is dissociated by immersion into an alkali solution after a color development treatment. However, under such a condition that the dye is dissociated, a remaining hydrazine compound itself is dissociated, and this dissociated compound tends to react with the coupler, to bring about the problem of causing considerable stain during long-time storage after the treatment.

SUMMARY OF THE INVENTION

An object of the present invention is to provide a light-sensitive material capable of reducing the amount of replenishing and discharging of a developer and capable of reducing stain of the light-sensitive material during storage after color development treatment.

Another object of the present invention is to provide an image-forming method that is capable of conveniently and rapidly treating a silver halide color photographic light-sensitive material.

Other and further objects, features, and advantages of the invention will appear more apparent from the following description.

DETAILED DESCRIPTION OF THE INVENTION

It has been found that the foregoing objects of the present invention can be attained by the following means.

(1) A silver halide color photographic light-sensitive material having at least one photographic constitutional layer coated on a support, wherein at least one of the photographic constitutional layers contains at least one reducing agent for color formation, represented by the following formula (I), at least one coupler for forming a diffusive dye, and at least one mordant:

$$Q \qquad C\alpha\text{-}NHNH-Z \qquad \text{Formula (I)}$$

wherein Cα represents a carbon atom; Z represents a carbamoyl group, an acyl group, an alkoxycarbonyl group, or an aryloxycarbonyl group; and Q represents a group of atoms to form, together with the Cα, an unsaturated ring.

(2) The silver halide color photographic light-sensitive material as stated in (1) above, wherein Z in formula (I) is a carbamoyl group having at least one hydrogen atom on a nitrogen atom.

(3) The silver halide color photographic light-sensitive material as stated in (2) above, wherein the unsaturated ring formed with the Cα and Q in formula (I) is a heterocyclic ring.

(4) The silver halide color photographic light-sensitive material as stated in (2) above, wherein the unsaturated ring formed with the Cα and Q in formula (I) is a benzene ring having at least one substituent, and wherein the sum of σ values for the Hammett's substituent constant of the substituents (σp value is used for the substituents on the carbon atom in 1,2 or 1,4 relation with the Cα (Cα is at 1-position), while σm value is used for the substituents on the carbon atom in 1,3 relation with the Cα) is 0.8 or more.

(5) An image-forming method, wherein the silver halide color photographic light-sensitive material stated in (1) above is subjected to development with an alkali solution after exposure to light image-wise.

(6) The image-forming method as stated in (5) above, wherein Z in formula (I) is a carbamoyl group having one or more hydrogen atoms on a nitrogen atom.

(7) The image-forming method as stated in (6) above, wherein the unsaturated ring formed with the Cα and Q in formula (I) is a heterocyclic ring.

(8) The image-forming method as stated in (6) above, wherein the unsaturated ring formed with the Cα and Q in formula (I) is a benzene ring having one or more substituents, and wherein the sum of σ value for the Hammett's substituent constant of the substituents (σp value is used for the substituents on the carbon atom in 1,2 or 1,4 relation with the Cα, while cm value is used for the substituents on the carbon atom in 1,3 relation with the Cα) is 0.8 or more.

The alkali solution referred to in (5) above is a developer (a developing solution) containing substantially no color-developing agent. This is different from that for alkali treatment after bleach-fixing and water washing (rinsing) used in examples to be described later. Since a dye formed from a conventional coupler does not dissociate under a neutral (or acidic) condition, and does not develop a color as a dye having a desired hue, the alkali treatment after the water washing to be described later is applied, in order to dissociate the dye and change it into the dye having the desired hue.

In the system of using a conventional coupler, a dye with a desired hue is not formed unless an alkali treatment is applied after water washing (rinsing). Moreover, there is also an additional problem of causing fogging in color formation (Dmin) with lapse of time under wet heat. On the contrary, in the system of the present invention, a dye with a desired hue can be formed without the alkali treatment. Moreover, since the alkali treatment is not applied, it is free from the problem of fogging in color formation with lapse of time under wet heat.

A dye obtained from a reducing agent for color formation and a coupler for forming a dye according to the present invention dissociates, to develop a color. A feature of the present invention resides in dissociating only the dye formed but not dissociating a remaining reducing agent for color formation, in order to prevent stains.

PREFERRED EMBODIMENTS OF THE INVENTION

The present invention is to be explained by way of practical embodiments in more detail.

Description is to be made specifically to a reducing agent for color formation used in the present invention.

The reducing agent for color formation represented by formula (I) used in the present invention is a compound capable of being oxidized, in an alkali solution, with a light-exposed silver halide, or a compound capable of being oxidized with an oxidized auxiliary developing agent by redox reaction, and each of the resulting oxidized products further forms a dye by reaction with a coupler for forming a dye.

The compound represented by formula (I) used in the present invention will be explained more in detail.

In formula (I), Z represents a carbamoyl group, an acyl group, an alkoxycarbonyl group, or an aryloxycarbonyl group. Preferred among them is a carbamoyl group, and a carbamoyl group having one or two hydrogen atoms on a nitrogen atom is particularly preferred.

The carbamoyl group preferably has from 1 to 50 carbon atoms, and more preferably 1 to 40. Specific examples include a carbamoyl group, a methylcarbamoyl group, an ethylcarbamoyl group, an n-propylcarbamoyl group, a sec-butylcarbamoyl group, an n-octylcarbamoyl group, a cyclohexylcarbamoyl group, a tert-butylcarbamoyl group, a dodecylcarbamoyl group, a 3-dodecyloxypropylcarbamoyl group, an octadecylcarbamoyl group, a 3-(2,4-tert-pentylphenoxy)-propylcarbamoyl group, a 2-hexyldecylcarbamoyl group, a phenylcarbamoyl group, a 4-dodecyloxyphenylcarbamoyl group, a 2-chloro-5-dodecyloxycarbonylphenylcarbamoyl group, a naphthylcarbamoyl group, a 3-pyridylcarbamoyl group, a 3,5-bis-octyloxycarbonylphenylcarbamoyl group, a 3,5-bis-tetradecyloxyphenylcarbamoyl group, a benzyloxycarbamoyl group, and a 2,5-dioxo-1-pyrrolidinylcarbamoyl group.

The acyl group preferably has from 1 to 50 carbon atoms, and more preferably from 1 to 40. Specific examples include a formyl group, an acetyl group, a 2-methylpropanoyl group, a cyclohexylcarbonyl group, an n-octanoyl group, a 2-hexyldecanoyl group, a dodecanoyl group, a chloroacetyl group, a trifluoroacetyl group, a benzoyl group, a 4-dodecyloxybenzoyl group, a 2-hydroxymethylbenzoyl group, and a 3-(N-hydroxy-N-methylaminocarbonyl) propanoyl group.

The alkoxycarbonyl group and the aryloxycarbonyl group, respectively, preferably have from 2 to 50 carbon atoms, and more preferably from 2 to 40. Specific examples include a methoxycarbonyl group, an ethoxycarbonyl group, an isobutyloxycarbonyl group, a cyclohexyloxycarbonyl group, a dodecyloxycarbonyl group, a benzyloxycarbonyl group, a phenoxycarbonyl group, a 4-octyloxyphenoxycarbonyl group, a 2-hydroxymethylphenoxycarbonyl group, and a 4-dodecyloxyphenoxycarbonyl group.

Q represents a group of atoms that form an unsaturated ring together with the Cα, in which the unsaturated ring formed is preferably a 3- to 8-membered ring, and more preferably a 5- to 6-membered ring. Examples of this unsaturated ring include aromatic rings (e.g. a benzen ring) and heterocyclic rings, and the preferable number of members in the ring is as described above. Preferred examples of them are a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole, a 1,3,4-oxadiazole ring, a 1,2,4-oxadiazole ring, a 1,2,5-oxadiazole ring, a thiazole ring, an oxazole ring, an isothiazole ring, an isooxazole ring, and a thiophene ring, and a condensed ring formed from the above-mentioned rings condensed with each other is also preferably used.

Further, the above-mentioned ring may have a substituent. Examples of the substituent include a straight-chain or branched, chain or cyclic alkali group having 1 to 50 carbon atoms (e.g. trifluoromethyl, methyl, ethyl, propyl, heptafluoropropyl, isopropyl, butyl, t-butyl, t-pentyl, cyclopentyl, cyclohexyl, octyl, 2-ethylhexyl and dodecyl); a straight-chain or branched, chain or cyclic alkenyl group having 2 to 50 carbon atoms (e.g. vinyl, 1-methylvinyl, and cyclohexene-1-yl), an alkynyl group having 2 to 50 total carbon atoms (e.g. ethynyl and 1-propynyl), an aryl group having 6 to 50 carbon atoms (e.g. phenyl, naphthyl, and anthryl), an acyloxy group having 1 to 50 carbon atoms (e.g. acetoxy, tetradecanoyloxy, and benzoyloxy), a carbamoyloxy group having 1 to 50 carbon atoms (e.g. N,N-dimethylcarbamoyloxy), a carbonamide group having 1 to 50 carbon atoms (e.g. formamide, N-methylacetoamide, acetoamide, N-methylformamide, and benzamide), a sulfoneamide group having 1 to 50 carbon atoms (e.g. methanesulfoneamide, dodecanesulfoneamide, benzenesulfoneamide, and p-toluene-sulfoneamide), a carbamoyl group having 1 to 50 carbon atoms (e.g. N-methylcarbamoyl, N,N-diethylcarbamoyl, and N-mesylcarbamoyl), a sulfamoyl group having 0 to 50 carbon atoms (e.g. N-butylsulfamoyl, N,N-diethylsulfamoyl, N-methyl-N-(4-methoxyphenyl) sulfamoyl), an alkoxy group having 1 to 50 carbon atoms (e.g. methoxy, propoxy, isopropoxy, octyloxy, t-octyloxy, dodecyloxy, and 2-(2,4-di-t-pentylphenoxy)ethoxy), an aryloxy group having 6 to 50 carbon atoms (e.g. phenoxy, 4-methoxyphenoxy, and naphthoxy), an aryloxycarbonyl group having 7 to 50 carbon atoms (e.g. phenoxycarbonyl and naphthoxycarbonyl), an alkoxycarbonyl group having 2 to 50 carbon atoms (e.g. methoxycarbonyl and t-butoxycarbonyl), an N-acylsulfamoyl group having 1 to 50 carbon atoms (e.g. N-tetradecanoylsulfamoyl and N-benzoylsulfamoyl), an alkylsulfonyl group having 1 to 50 carbon atoms (e.g. methanesulfonyl, octylsulfonyl, 2-methoxyethylsulfonyl and 2-hexyldecylsulfonyl), an arylsulfonyl group having 6 to 50 carbon atoms (e.g. benzenesulfonyl, p-toluenesulfonyl, and 4-phenylsulfonylphenylsulfonyl), an alkoxycarbonylamino group having 2 to 50 carbon atoms (e.g. ethoxycarbonylamino), an aryloxycarbonylamino group having 7 to 50 carbon atoms (e.g. phenoxycarbonylamino and naphthoxycarbonylamino), an amino group having 0 to 50 carbon atoms (e.g. amino, methylamino, diethylamino, diisopropylamino, anylino, and morpholino), a cyano group, a nitro group, a carboxyl group, a hydroxy group, a sulfo group, a mercapto group, an alkylsulfinyl group having 1 to 50 carbon atoms (e.g. methanesulfinyl and octanesulfinyl), an arylsulfinyl group having 6 to 50 carbon atoms (e.g. benzenesulfinyl, 4-chlorophenylsulfinyl, and p-toluenesulfinyl), an alkylthio group having 1 to 50 carbon atoms (e.g. methylthio, octylthio, and cyclohexylthio), an arylthio group having 6 to 50 carbon atoms (e.g. phenylthio and naphthylthio), an ureido group having 1 to 50 carbon atoms (e.g. 3-methylureido, 3,3-dimethylureido, and 1,3-diphenylureido), a heterocyclic group having 2 to 50 carbon atoms (a 3- to 12-membered monocyclic or condensed ring containing, for example, at least one nitrogen, oxygen, or sulfur as hetero atoms, e.g. 2-furyl, 2-pyranyl, 2-pyridyl, 2-thienyl, 2-imidazolyl, morpholino, 2-quinolyl, 2-benzimidazolyl, 2-benzothiazolyl and 2-benzooxazolyl), an acyl group having 1 to 50 carbon atoms (e.g. acetyl, benzoyl and trifluoroacetyl), a sulfamoylamino group having 0 to 50 carbon atoms (e.g. N-butylsulfamoylamino and N-phenylsulfamoylamino), a silyl group having 3 to 50 carbon atoms (e.g. trimethylsilyl, dimethyl-t-butylsilyl and triphenylsilyl) and a halogen atom (e.g. fluorine atom, chlorine atom, and bromine atom). The substituent described above may have a substituent, and those substituents mentioned above can be mentioned as examples for such a substituent.

The number of carbon atoms of the substituent is preferably 50 or below, and more preferably 42 or below. Further, the total carbon atoms of the unsaturated ring formed with Q and the Cα and the substituents thereon is preferably 30 or below, more preferably 24 or below, and most preferably 18 or below.

When the ring formed with Q and the Cα consists only of carbon atoms, on which the substituents are present (e.g. a benzene ring, a naphthalene ring, and an anthrathene ring), the sum of the σ values of the Hammett's substituent constant (σp value is used when the substituent is at 1,2, 1,4, . . . relation with the Cα and σm value is used when the substituent is at 1,3, 1,5, . . . relation with the Cα) for all substituents is 0.8 or more, more preferably 1.2 or more, and most preferably 1.5 or more. There is no particular restriction on the upper limit, but it is preferably 3.8 or below, in view of easy availability of the compound.

Herein, Hammett substituent constants σp and σm are described in detail in such books as "Hammett no Hosoku/Kozo to Hannousei," written by Naoki Inamoto (Maruzen); "Shin-jikken Kagaku-koza 14/Yukikagoubutsu no Gosei to Hanno V," page 2605 (edited by Nihonkagakukai, Maruzen); "Riron Yukikagaku Kaisetsu," written by Tadao Nakaya, page 217 (Tokyo Kagakudojin); and "Chemical Review" (Vol. 91), pages 165 to 195 (1991).

Now, specific examples of the reducing agent for color formation represented by formula (I) used in the present invention are described below, but the scope of the present invention is not limited to them.

(1)

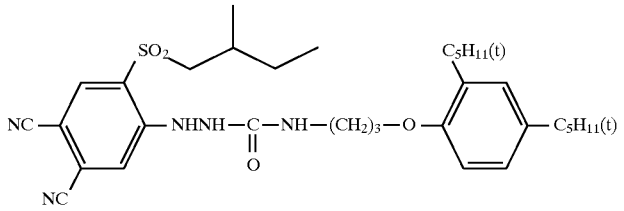

(2)

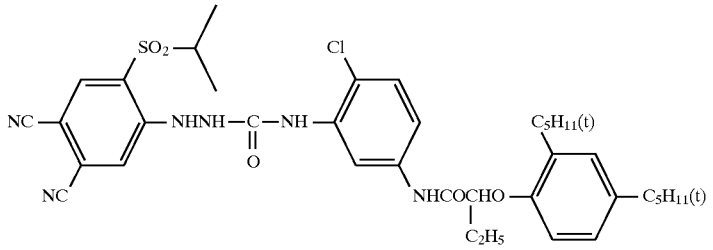

-continued
(3)
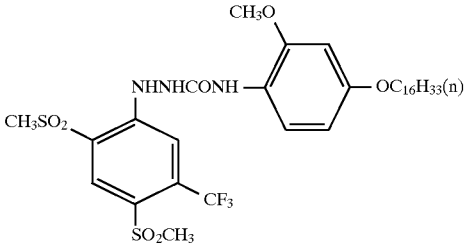
(4)
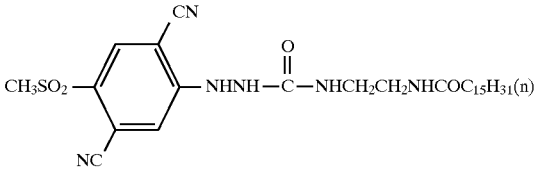
(5)
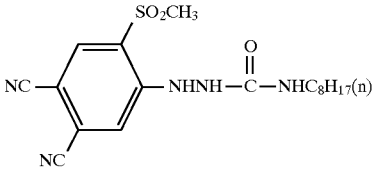
(6)
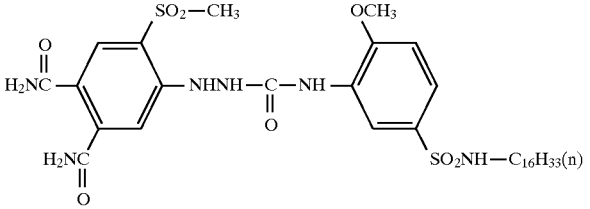
(7)
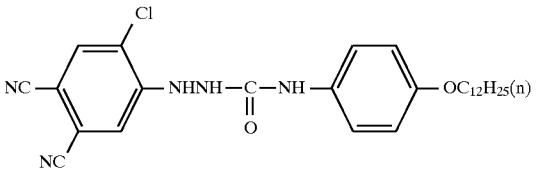
(8)
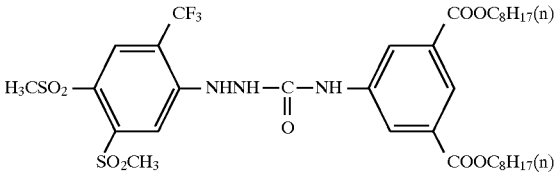
(9)
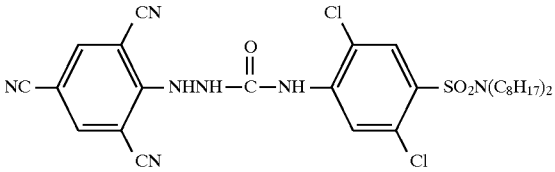
(10)
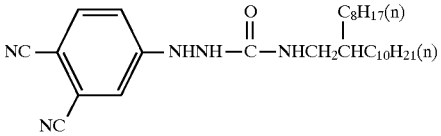

-continued
(11)
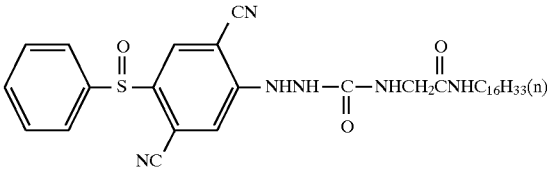
(12)
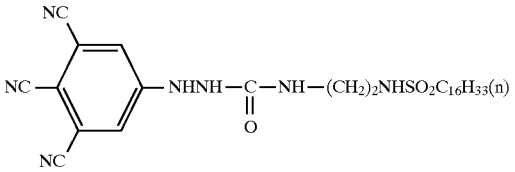
(13)
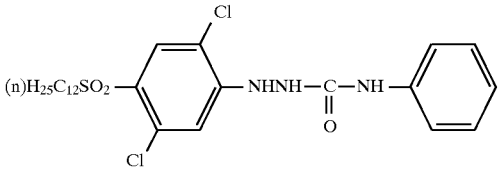
(14)
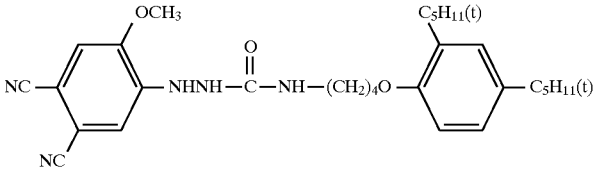
(15)
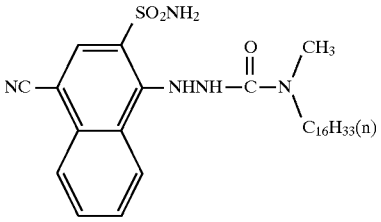
(16)
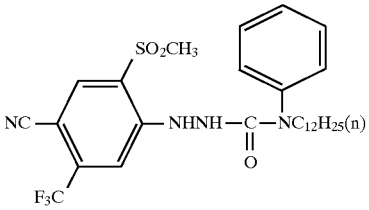
(17)
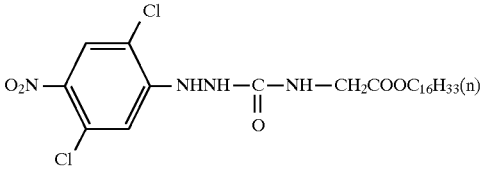
(18)
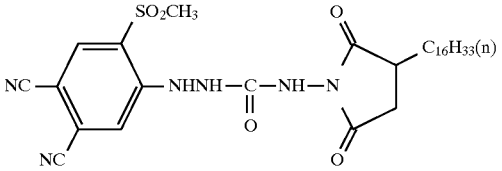

-continued
(19)
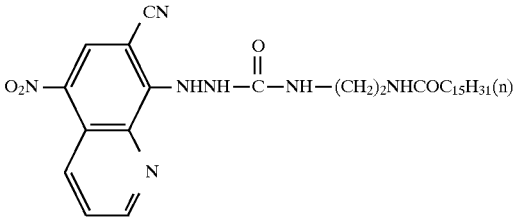
(20)
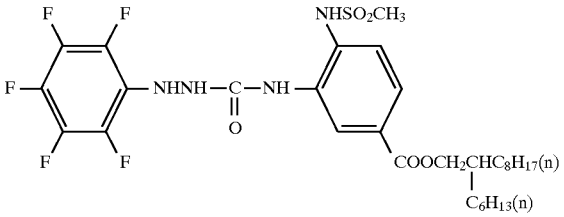
(21)
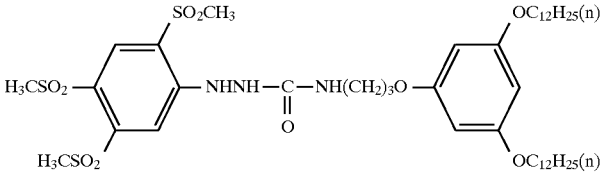
(22)
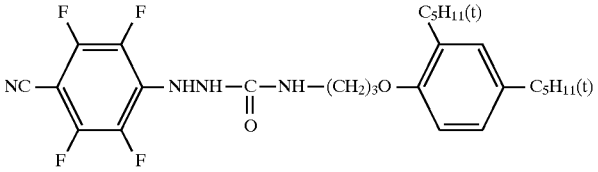
(23)
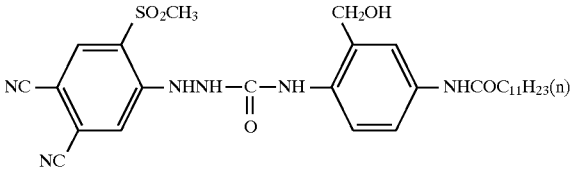
(24)
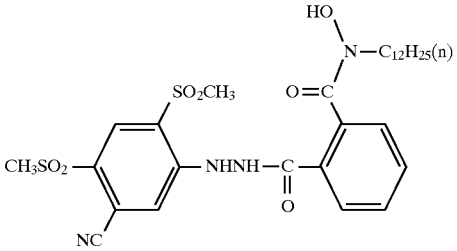
(25)
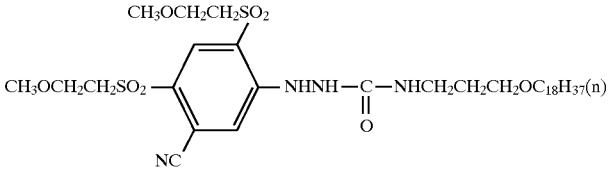

-continued
(26)
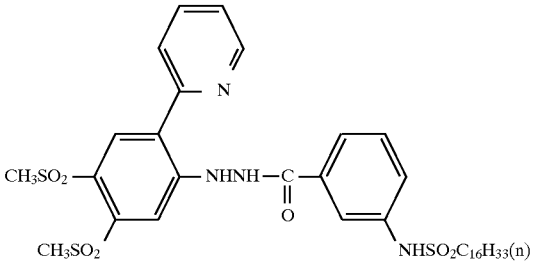
(27)
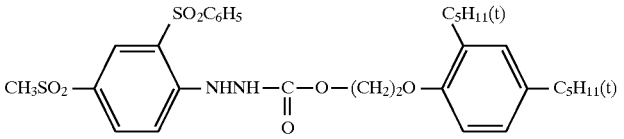
(28)
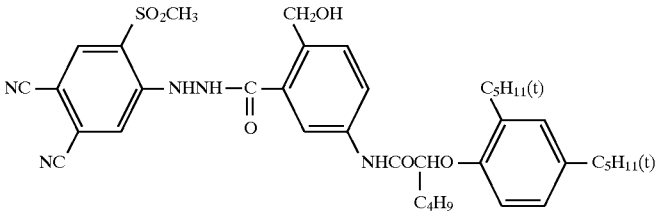
(29)
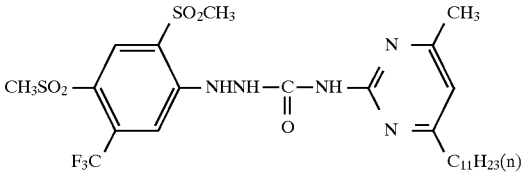
(30)
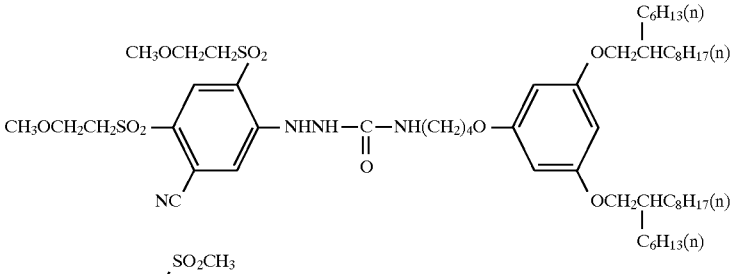
(31)
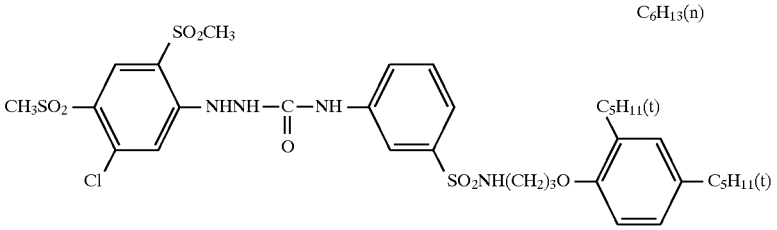
(32)
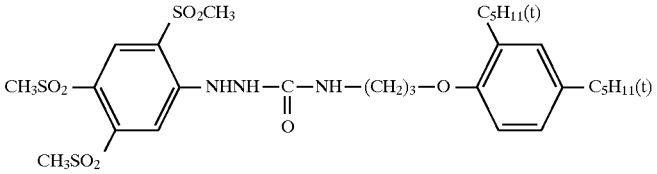
(33)
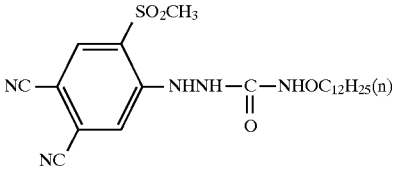

-continued
(34)
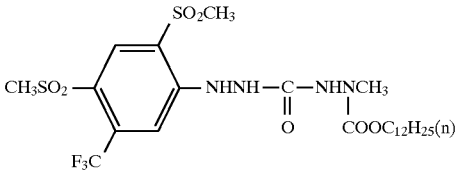
(35)
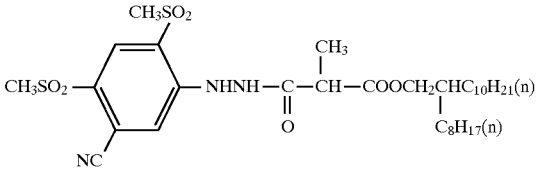
(36)
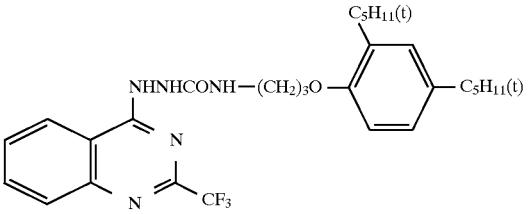
(37)
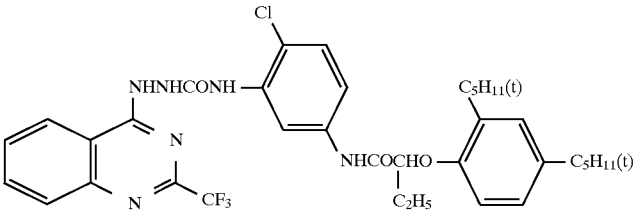
(38)
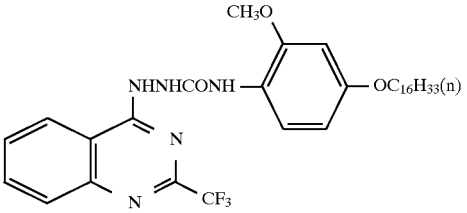
(39)
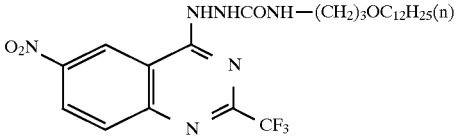
(40)
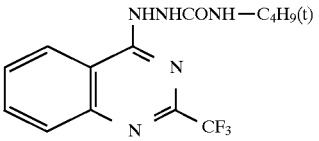
(41)
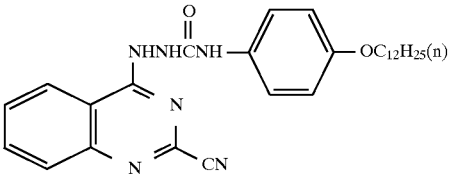

-continued
(42)
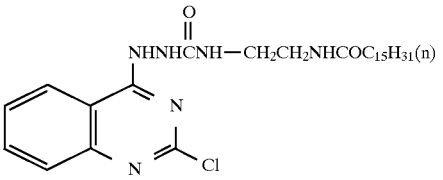
(43)
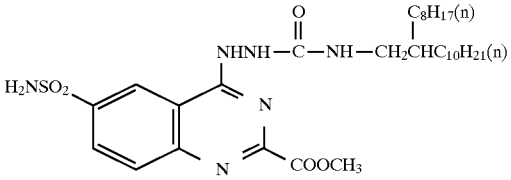
(44)
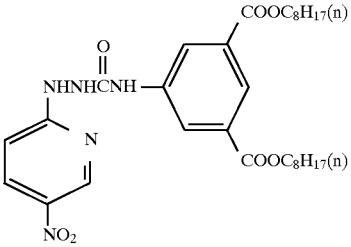
(45)
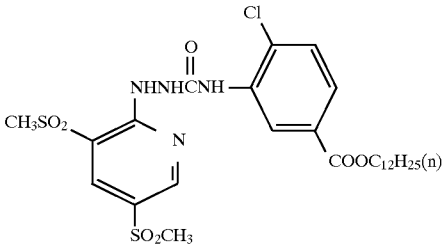
(46)
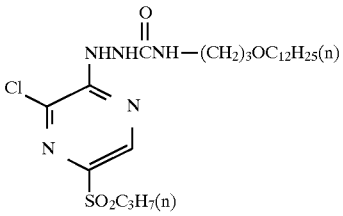
(47)
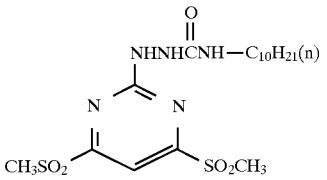
(48)
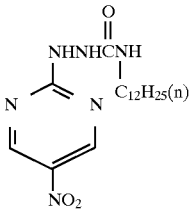

-continued
(49)
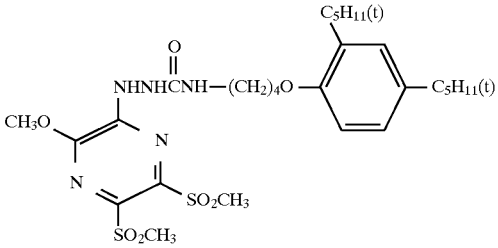
(50)
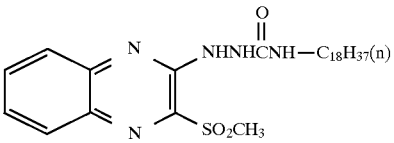
(51)
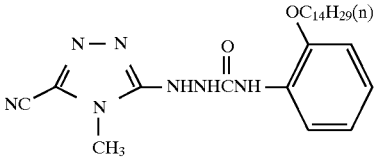
(52)
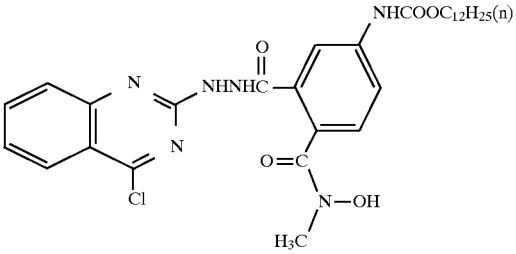
(53)
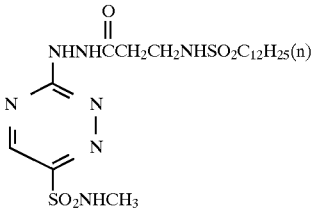
(54)
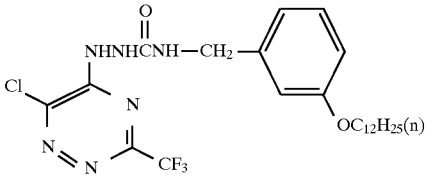
(55)
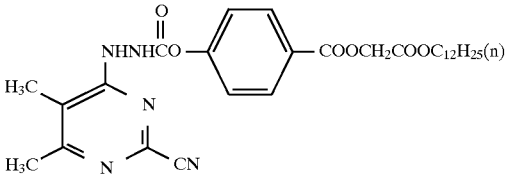

-continued
(56)
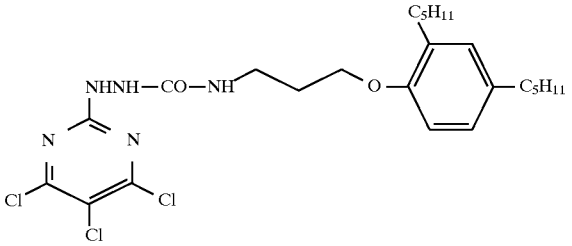
(57)
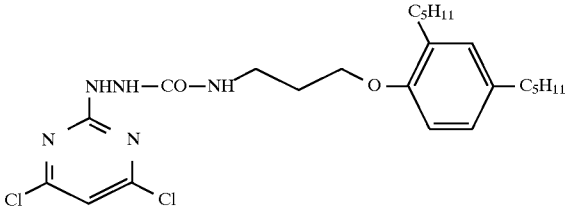
(58)
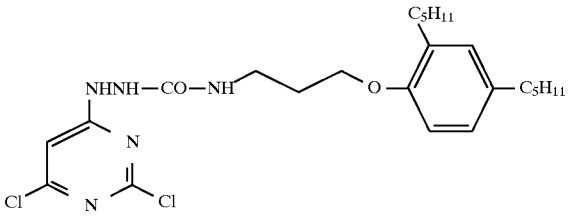
(59)
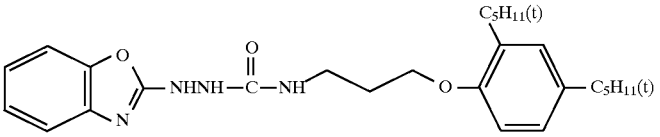
(60)
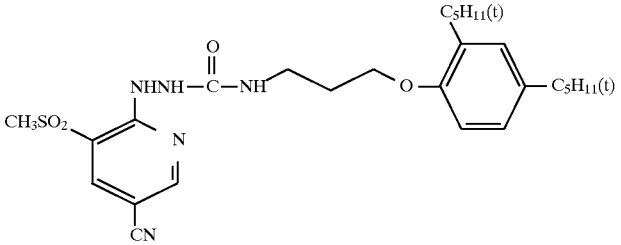
(61)
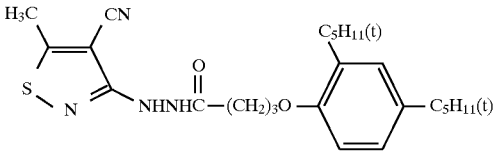
(62)
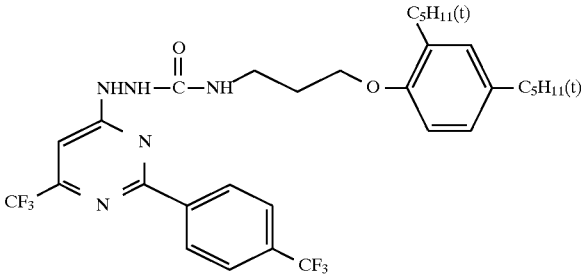

-continued (63)

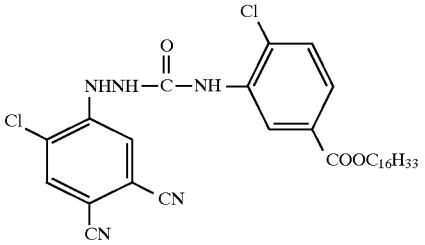

(64)

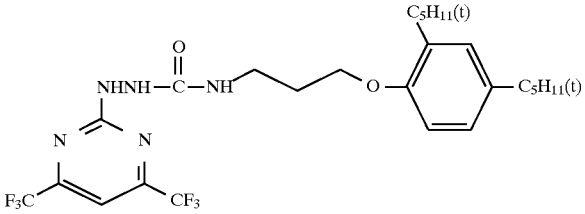

(65)

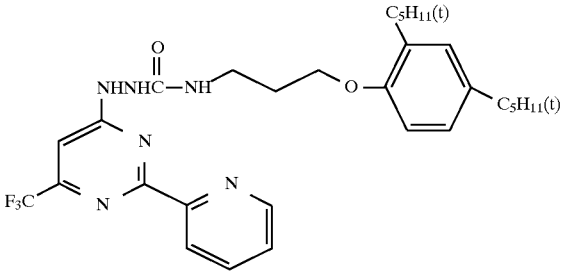

The reducing agent for color formation for use in the present invention is used together with a compound that can form a dye by oxidation coupling reaction (a coupler). The coupler can be a coupler not substituted or substituted, at a coupling position with the oxidized product of the developing agent (i.e. a four-equivalent coupler, a two-equivalent coupler), but in the present invention, a two-equivalent coupler (substituted at its coupling position) is preferred. Specific examples of the coupler are described in detail, for example, in "Theory of the Photographic Process" (4th Ed., Edited by T. H. James, Macmillan, 1977), pp. 291 to 334 and pp. 354 to 361, and in JP-A Nos. 12353/1983, 149046/1983, 149047/1983, 11114/1984, 124399/1984, 174835/1984, 231539/1984, 231540/1984, 2951/1985, 14242/1985, 23474/1985, and 66249/1985.

As the coupler for use in the present invention, any coupler can be used, provided that a diffusive dye formed by coupling with an oxidized product of a reducing agent for color formation for use in the present invention reaches a mordant. Preferably the diffusive dye formed has one or more dissociation groups with a pKa of 12 or below, more preferably one or more dissociation groups with a pKa of 8 or below, and particularly preferably one or more dissociation group with a pKa of 6 or below. Further, from the viewpoint of providing diffusibility, the molecular weight of the diffusive dye formed is preferably 200 or more but 2000 or below. Further, the ratio of the molecular weight of dye formed to the number of dissociation groups with pKa of 12 or below is preferably 100 or more but 2000 or below, and more preferably 100 or more but 1000 or below. The value measured by using a solvent at dimethylformamide:water=1:1, is used for the value of pKa.

As the solubility of the diffusive dye formed by the coupling of the coupler for use in the present invention and the oxidized product of the reducing agent for color formation for use in the present invention, the diffusive dye is dissolved in an alkali solution of pH 11 at 25° C. in an amount of preferably $1\times10^{-6}$ mol/l or more, more preferably $1\times10^{-5}$ mol/l or more, and particularly preferably $1\times10^{-4}$ mol/l or more. Further, the diffusion constant of the diffusive dye formed by the coupling between the coupler for use in the present invention and the oxidized product of the reducing agent for color formation for use in the present invention, when the diffusive dye is dissolved at a concentration of $10^{-4}$ mol/l in an alkali solution at pH 11 at 25° C., is preferably $1\times10^{-8}$ $m^2/s^{-1}$ or more, more preferably $1\times10^{-7}$ $m^2/s^{-1}$ or more, and particularly preferably $1\times10^{-6}$ $m^2/s^{-1}$ or more.

Examples of the coupler used preferably in the present invention are described below.

The coupler used preferably in the present invention can include compounds of the structure described by one of the following formulae (1) to (12). They are compounds generally referred to collectively as active methylenes, pyrazolones, pyrazoloazoles, phenols, naphthols, and pyrrolotriazoles, respectively, which are compounds known in the relevant field of the art.

$$R^{14}-\underset{\underset{Y}{|}}{CH}-CONH-R^{15} \quad (1)$$

$$R^{14}-\underset{\underset{Y}{|}}{CH}-COO-R^{15} \quad (2)$$

$$R^{14}-\underset{\underset{Y}{|}}{CH}-CO-R^{15} \quad (3)$$

-continued (4)

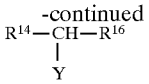

(5)

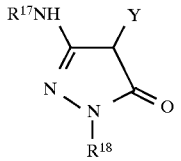

(6)

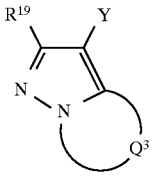

(7)

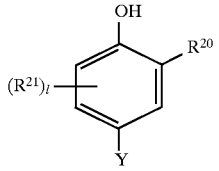

(8)

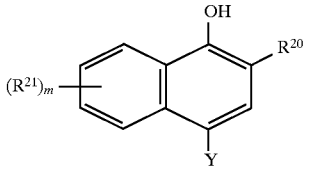

(9)

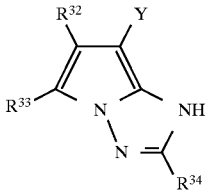

(10)

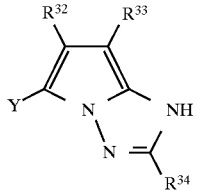

(11)

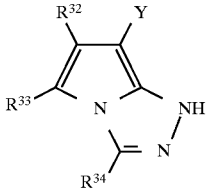

(12)

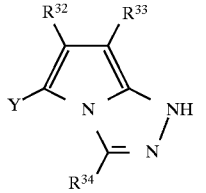

Formulae (1) to (4) represent couplers that are called active methylene-series couplers, and, in the formulae, $R^{14}$ represents an acyl group, a cyano group, a nitro group, an aryl group, a heterocyclic residue, an alkoxycarbonyl group, an aryloxycarbonyl group, a carbamoyl group, a sulfamoyl group, an alkylsulfonyl group, or an arylsulfonyl group, optionally substituted.

In formulae (1) to (3), $R^{15}$ represents an optionally substituted alkyl group, aryl group, or heterocyclic residue. In formula (4), $R^{16}$ represents an optionally substituted aryl group or heterocyclic residue. Examples of the substituent that may be possessed by $R^{14}$, $R^{15}$, and $R^{16}$ include those mentioned for the substituent on the ring formed with Q and the Cα.

In formulae (1) to (4), Y is a hydrogen atom or a group that provides the coupler a resistance to diffusion and that is capable of coupling split-off by coupling reaction with the oxidized product of the reducing agent for color formation. Examples of Y are a hydrogen atom, a heterocyclic group (a saturated or unsaturated 5-membered to 7-membered monocyclic or condensed ring having as a hetero atom at least one nitrogen atom, oxygen atom, sulfur atom, or the like, e.g. succinimido, maleinimido, phthalimido, diglycolimido, pyrrole, pyrazole, imidazole, 1,2,4-triazole, tetrazole, indole, benzopyrazole, benzimidazole, benzotriazole, imidazolin-2,4-dione, oxazolidin-2,4-dione, thiazolidin-2,4-dione, imidazolidin-2-one, oxazolin-2-one, thiazolin-2-one, benzimidazolin-2-one, benzoxazolin-2-one, benzthiazolin-2-one, 2-pyrrolin-5-one, 2-imidazolin-5-one, indolin-2,3-dione, 2,6-dioxypurine, parabic acid, 1,2,4-triazolidin-3,5-dione, 2-pyridone, 4-pyridone, 2-pyrimidone, 6-pyridazone, 2-pyrazone, 2-amino-1,3,4-thiazolodine, and 2-imino-1,3,4-thiazolidin-4-one), a halogen atom (e.g. a chlorine atom and a bromine atom), an aryloxy group (e.g. phenoxy and 1-naphthoxy), a heterocyclic oxy group (e.g. pyridyloxy and pyrazolyoxy), an acyloxy group (e.g. acetoxy and benzoyloxy), an alkoxy group (e.g. methoxy and dodecyloxy), a carbamoyloxy group (e.g. N,N-diethylcarbamoyloxy and morpholinocarbonyloxy), an aryloxycarbonyloxy group (e.g. phenylcarbonyloxy), an alkoxycarbonyloxy group (e.g. methoxycarbonyloxy and ethoxycarbonyloxy), an arylthio group (e.g. phenylthio and naphthylthio), a heterocyclic thio group (e.g. tetrazolylthio, 1,3,4-thiadiazolylthio, 1,3,4-oxadiazolylthio, and benzimidazolylthio), an alkylthio group (e.g. methylthio, octylthio, and hexadecylthio), an alkylsulfonyloxy group (e.g. methanesulfonyloxy), an arylsulfonyloxy group (e.g. benzenesulfonyloxy and toluenesulfonyloxy), a carbonamido group (e.g. acetamido and trifluoroacetamido), a sulfonamido group (e.g. methanesulfonamido and benzenesulfonamido), an alkylsulfonyl group (e.g. methanesulfonyl), an arylsulfonyl group (e.g. benzenesulfonyl), an alkylsulfinyl group (e.g. methanesulfinyl), an arylsulfinyl group (e.g. benzenesulfinyl), an arylazo group (e.g. phenylazo and naphthylazo), and a carbamoylamino group (e.g. N-methylcarbamoylamino).

Y may be substituted, and examples of the substituent that may be possessed by Y include those mentioned for the substituent on the ring formed by Q and the Cα. Total number of carbon atoms included in Y are preferably 6 or more but 50 or below, more preferably 8 or more but 40 or below, and most preferably 10 or more but 30 or below.

Preferably Y represents an aryloxy group, a heterocyclic oxy group, an acyloxy group, an aryloxycarbonyloxy group, an alkoxycarbonyloxy group, or a carbamoyloxy group.

In formulae (1) to (4), $R^{14}$ and $R^{15}$, and $R^{14}$ and $R^{16}$, may bond together to form a ring.

Formula (5) represents a coupler that is called a 5-pyrazolone-series coupler, and in the formula, $R^{17}$ represents an alkyl group, an aryl group, an acyl group, or a carbamoyl group. $R^{18}$ represents a phenyl group or a phenyl group that is substituted by one or more halogen atoms, alkyl groups, cyano groups, alkoxy groups, alkoxycarbonyl groups, or acylamino groups.

Preferable 5-pyrazolone couplers represented by formula (5) are those wherein $R^{17}$ represents an aryl group or an acyl group, and $R^{18}$ represents a phenyl group that is substituted by one or more halogen atoms.

With respect to these preferable groups, more particularly, $R^{17}$ is an aryl group, such as a phenyl group, a 2-chlorophenyl group, a 2-methoxyphenyl group, a 2-chloro-5-tetradecaneamidophenyl group, a 2-chloro-5-(3-octadecenyl-1-succinimido)phenyl group, a 2-chloro-5-octadecylsulfonamidophenyl group, and a 2-chloro-5-[2-(4-hydroxy-3-t-butylphenoxy)tetradecaneamido]phenyl group; or $R_{17}$ is an acyl group, such as an acetyl group, a 2-(2,4-di-t-pentylphenoxy)butanoyl group, a benzoyl group, and a 3-(2,4-di-t-amylphenoxyacetamido)benzoyl group, any of which may have a substituent, such as a halogen atom or an organic substituent that is bonded through a carbon atom, an oxygen atom, a nitrogen atom, or a sulfur atom. Y has the same meaning as defined above.

Preferably $R^{18}$ represents a substituted phenyl group, such as a 2,4,6-trichlorophenyl group, a 2,5-dichlorophenyl group, and a 2-chlorophenyl group.

Formula (6) represents a coupler that is called a pyrazoloazole-series coupler, and, in the formula, $R^{19}$ represents a hydrogen atom or a substituent. $Q^3$ represents a group of nonmetal atoms required to form a 5-membered azole ring containing 2 to 4 nitrogen atoms, which azole ring may have a substituent (including a condensed ring).

Preferable pyrazoloazole couplers represented by formula (6), in view of spectral absorption characteristics of the color-formed dyes, are imidazo[1,2-b]pyrazoles described in U.S. Pat. No. 4,500,630, pyrazolo[1,5-b]-1,2,4-triazoles described in U.S. Pat. No. 4,500,654, and pyrazolo[5,1-c]-1,2,4-triazoles described in U.S. Pat. No. 3,725,067.

Details of substituents of the azole rings represented by the substituents $R^{19}$ and $Q^3$ are described, for example, in U.S. Pat. No. 4,540,654, the second column, line 41, to the eighth column, line 27. Preferable pyrazoloazole-series couplers are pyrazoloazole couplers having a branched alkyl group directly bonded to the 2-, 3-, or 6-position of the pyrazolotriazole group, as described in JP-A No. 65245/1986; pyrazoloazole couplers containing a sulfonamido group in the molecule, as described in JP-A No. 65245/1986; pyrazoloazole couplers having an alkoxyphenylsulfonamido ballasting group, as described in JP-A No. 147254/1986; pyrazolotriazole couplers having an alkoxy group or an aryloxy group at the 6-position, as described in JP-A No. 209457/1987 or 307453/1988; and pyrazolotriazole couplers having a carbonamido group in the molecule, as described in Japanese Patent Application No. 22279/1989. Y has the same meaning as defined above.

Formulae (7) and (8) are respectively called phenol-series couplers and naphthol-series couplers, and in the formulae $R^{20}$ represents a hydrogen atom or a group selected from the group consisting of $—CONR^{22}R^{23}$, $—SO_2NR^{22}R^{23}$, $—NHCOR^{22}$, $—NHCONR^{22}R^{23}$, and $—NHSO_2NR^{22}R^{23}$. $R^{22}$ and $R^{23}$ each represent a hydrogen atom or a substituent. In formulae (7) and (8), $R^{21}$ represents a substituent, 1 is an integer selected from 0 to 2, and m is an integer selected from 0 to 4. When 1 and m are 2 or more, $R^{21}$'s may be different. The substituents of $R^{21}$ to $R^{23}$ include those mentioned for substituent of the unsaturated ring formed by Q and the Cα. Y has the same meaning as defined above.

Preferable examples of the phenol-series couplers represented by formula (7) include 2-acylamino-5-alkylphenol couplers described, for example, in U.S. Pat. Nos. 2,369,929, 2,801,171, 2,772,162, 2,895,826, and 3,772,002; 2,5-diacylaminophenol couplers described, for example, in U.S. Pat. Nos. 2,772,162, 3,758,308, 4,126,396, 4,334,011, and 4,327,173, West Germany Patent Publication No. 3,329,729, and JP-A No. 166956/1984; and 2-phenylureido-5-acylaminophenol couplers described, for example, in U.S. Pat. Nos. 3,446,622, 4,333,999, 4,451,559, and 4,427,767. Y has the same meaning as defined above.

Preferable examples of the naphthol-series couplers represented by formula (8) include 2-carbamoyl-1-naphthol couplers described, for example, in U.S. Pat. Nos. 2,474,293, 4,052,212, 4,146,396, 4,282,233, and 4,296,200; and 2-carbamoyl-5-amido-1-naphthol couplers described, for example, in U.S. Pat. No. 4,690,889. Y has the same meaning as defined above.

Formulas (9) to (12) are couplers called pyrrolotriazoles, and $R^{32}$, $R^{33}$, and $R^{34}$ each represent a hydrogen atom or a substituent. Y has the same meaning as defined above. Examples of the substituent of $R^{32}$, $R^{33}$, and $R^{34}$ include those mentioned as examples for substituent being capable of substituting on the ring formed by Q and the Cα in formula (I). Preferable examples of the pyrrolotriazole-series couplers represented by formulae (9) to (12) include those wherein at least one of $R^{32}$ and $R^{33}$ is an electron-attracting group, which specific couplers are described in European Patent Nos. 488,248A1, 491,197A1, and 545,300. Y has the same meaning as defined above.

Further, a fused-ring phenol, an imidazole, a pyrrole, a 3-hydroxypyridine, an active methylene, an active methine, a 5,5-ring-fused heterocyclic, and a 5,6-ring-fused heterocyclic coupler, can be used.

As the fused-ring phenol-series couplers, those described, for example, in U.S. Pat. Nos. 4,327,173, 4,564,586, and 4,904,575, can be used.

As the imidazole-series couplers, those described, for example, in U.S. Pat. Nos. 4,818,672 and 5,051,347, can be used.

As the 3-hydroxypyridine-series couplers, those described, for example, in JP-A No. 315736/1989, can be used.

As the active methylene-series and active methine-series couplers, those described, for example, in U.S. Pat. Nos. 5,104,783 and 5,162,196, can be used.

As the 5,5-ring-fused heterocyclic couplers, for example, pyrrolopyrazole couplers described in U.S. Pat. No. 5,164,289, and pyrroloimidazole couplers described in JP-A No. 174429/1992, can be used.

As the 5,6-ring-fused heterocyclic couplers, for example, pyrazolopyrimidine couplers described in U.S. Pat. No. 4,950,585, pyrrolotriazine couplers described in JP-A No. 204730/1992, and couplers described in European Patent No. 556,700, can be used.

In the present invention, in addition to the above couplers, use can be made of couplers described, for example, in West Germany Patent Nos. 3,819,051A and 3,823,049, U.S. Pat. Nos. 4,840,883, 5,024,930, 5,051,347, and 4,481,268, European Patent Nos. 304,856A2, 329,036, 354,549A2, 374,781A2, 379,110A2, and 386,930A1, and JP-A Nos. 141055/1988, 32260/1989, 32261/1989, 297547/1990, 44340/1990, 110555/1990, 7938/1991, 160440/1991, 172839/1991, 172447/1992, 179949/1992, 182645/1992, 184437/1992, 188138/1992, 188139/1992, 194847/1992, 204532/1992, 204731/1992, and 204732/1992.

In the coupler used in the present invention, the total number of carbon atoms in the portion except for Y, from the viewpoint that a released dye tends to be diffusive, is preferably 3 or more but 30 or below, more preferably 3 or more but 24 or below, and most preferably 3 or more but 18 or below.

Specific examples of the couplers that can be used in the present invention are shown below, but, of course, the present invention is not limited to them:

(C-1)

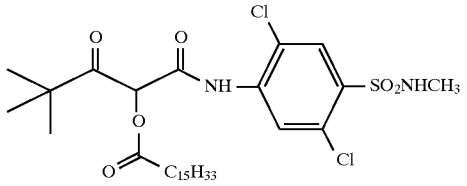

(C-2)

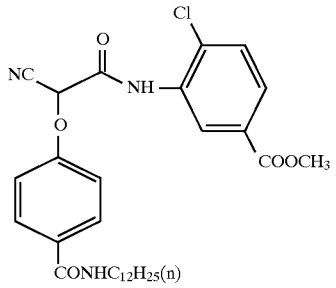

(C-3)

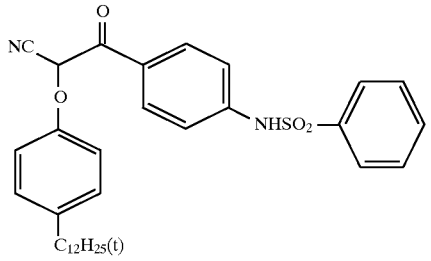

(C-4)

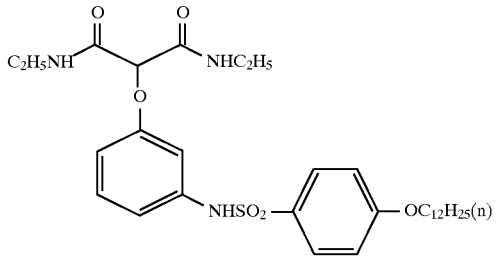

(C-5)

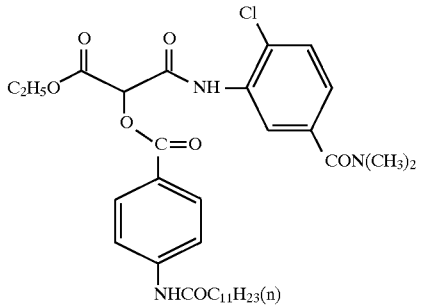

-continued
(C-6)
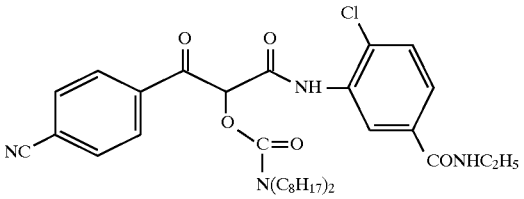
(C-7)
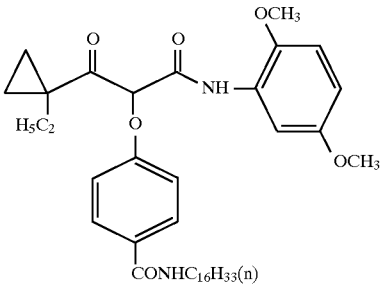
(C-8)
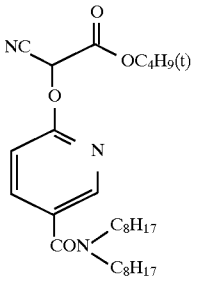
(C-9)
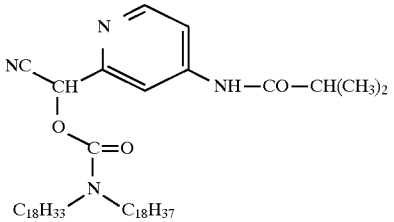
(C-10)
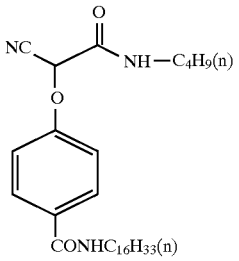

-continued
(C-11)
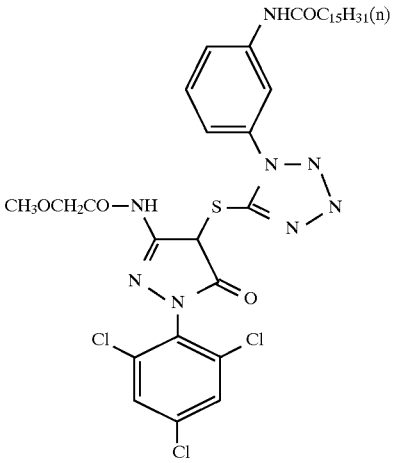
(C-12)
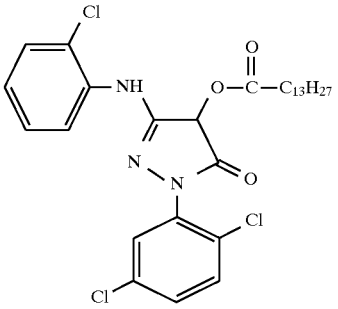
(C-13)
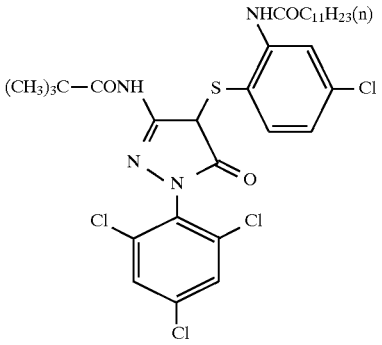
(C-14)
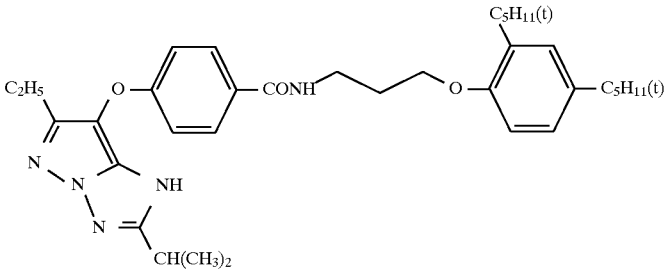

-continued
(C-15)
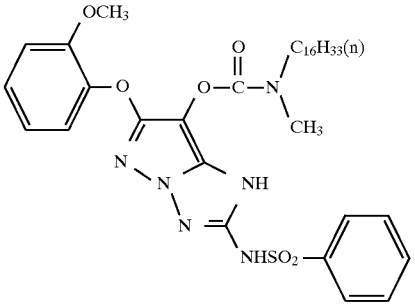
(C-16)
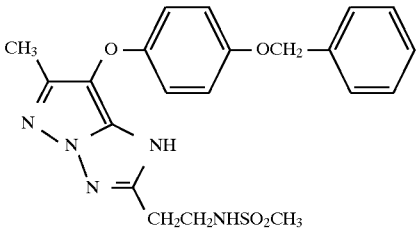
(C-17)
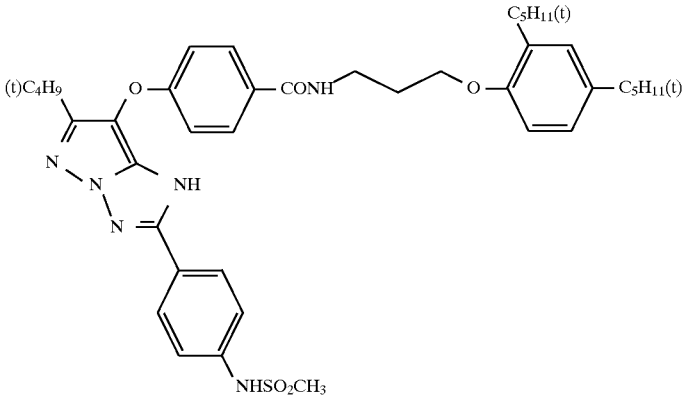
(C-18)
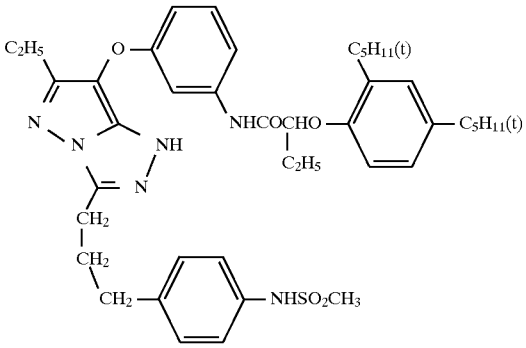
(C-19)
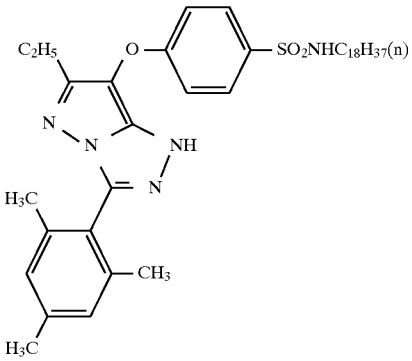

-continued
(C-20)
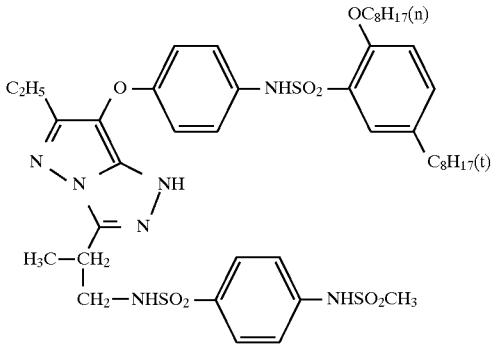
(C-21)
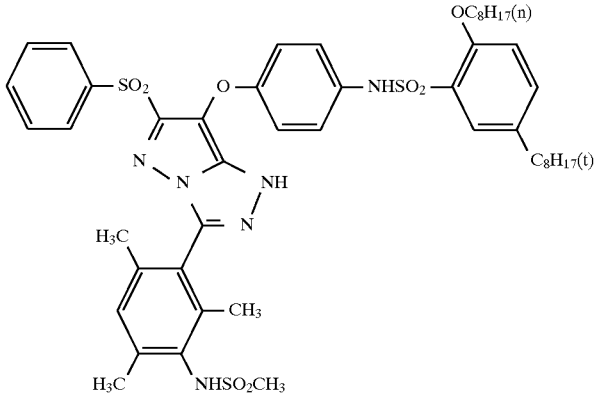
(C-21)
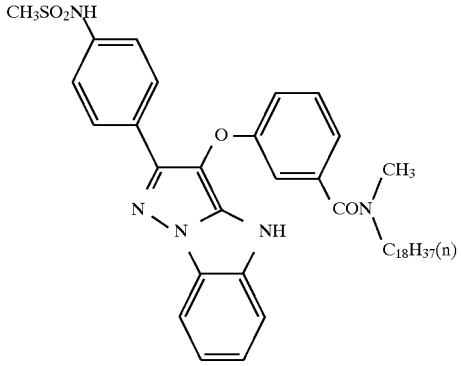
(C-22)
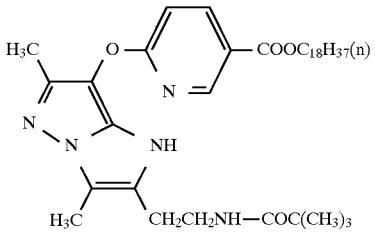
(C-23)
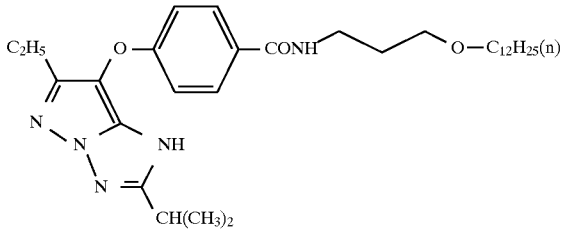

-continued
(C-24)
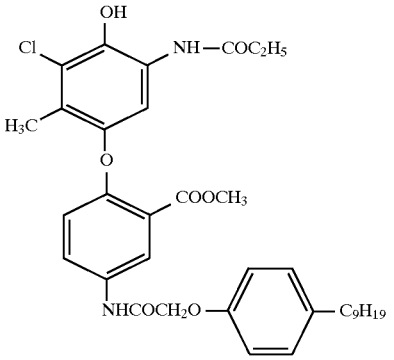
(C-25)
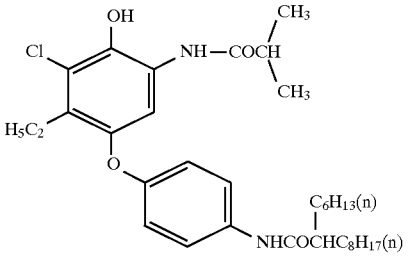
(C-26)
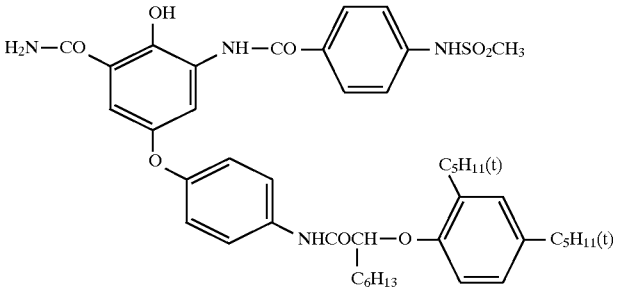
(C-27)
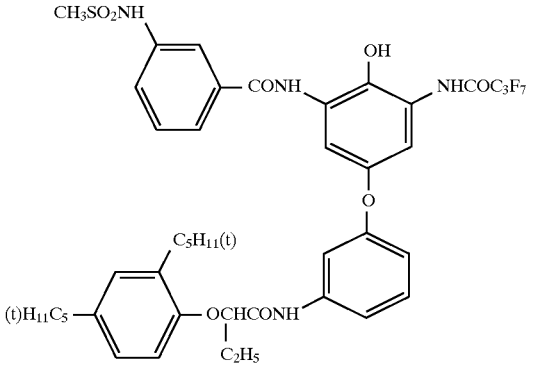
(C-28)
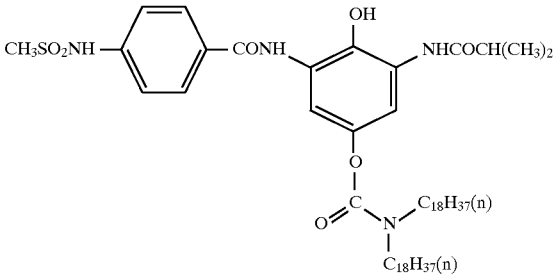

-continued
(C-29)
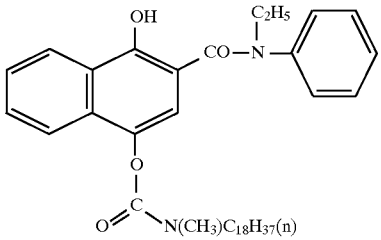
(C-30)
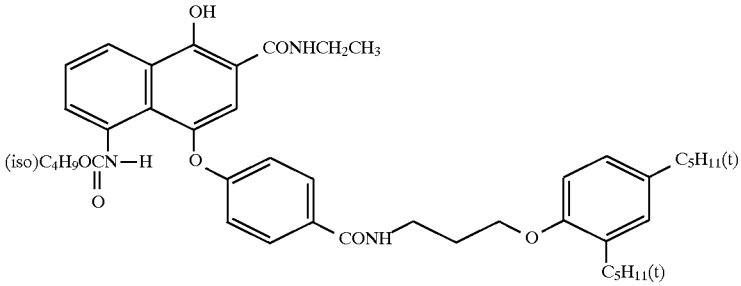
(C-31)
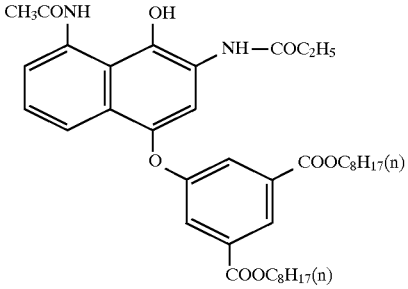
(C-32)
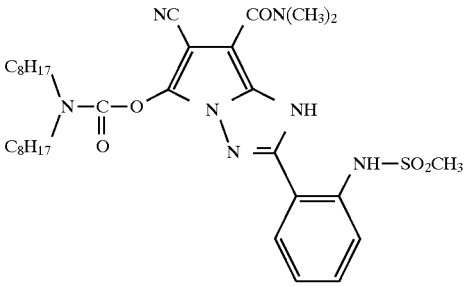
(C-33)
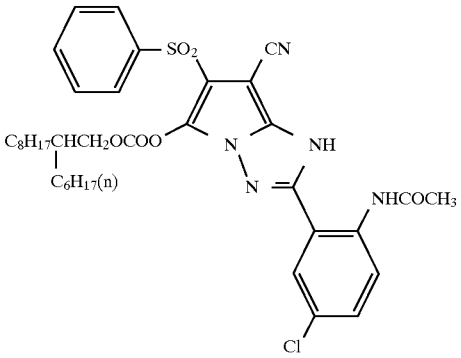

-continued
(C-34)
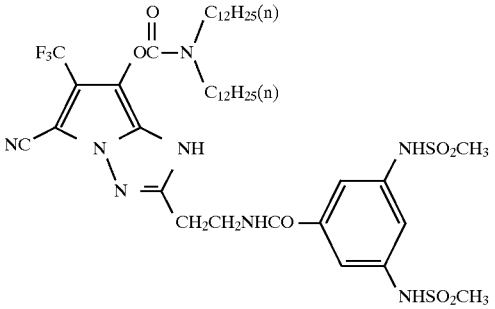
(C-35)
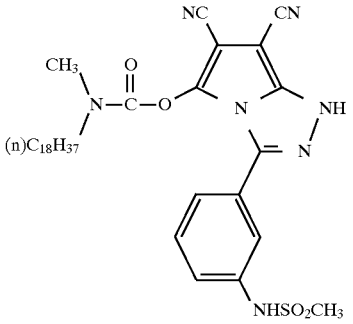
(C-36)
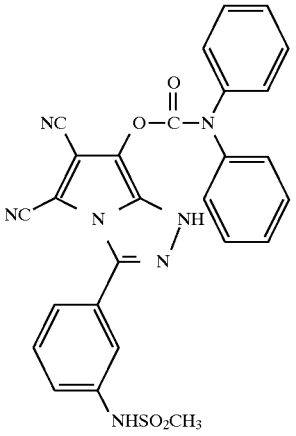
(C-37)
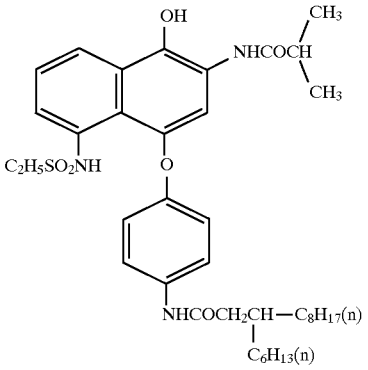

-continued
(C-38)
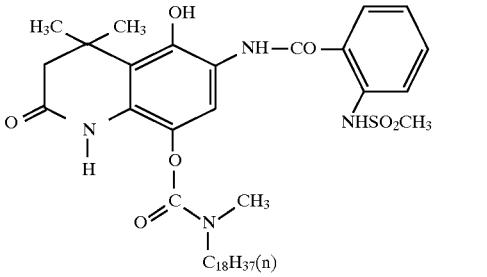
(C-39)
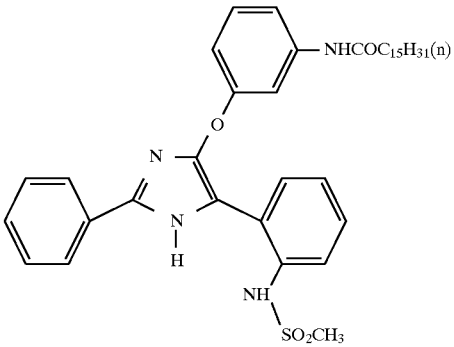
(C-40)
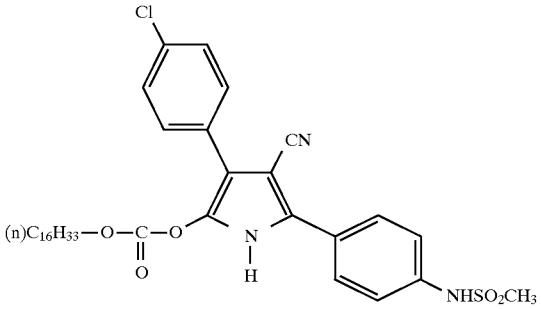
(C-41)
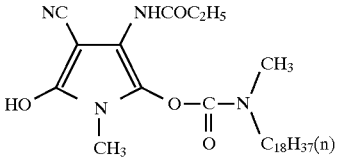
(C-42)
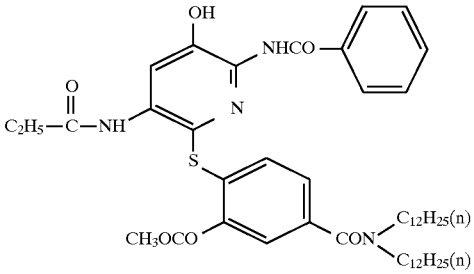
(C-43)
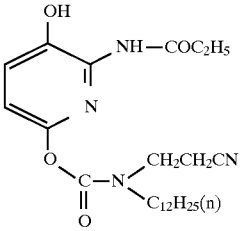

-continued
(C-44)
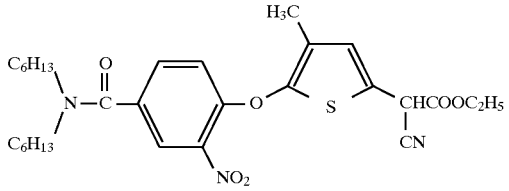
(C-45)
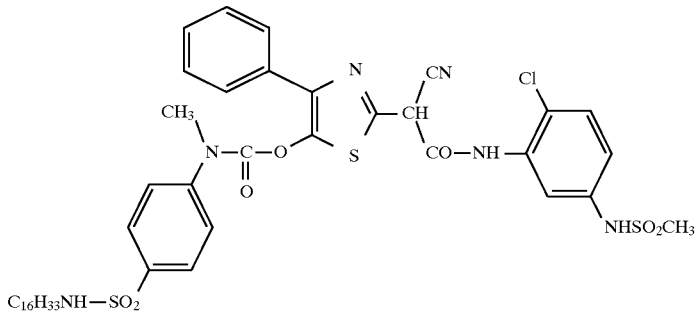
(C-46)
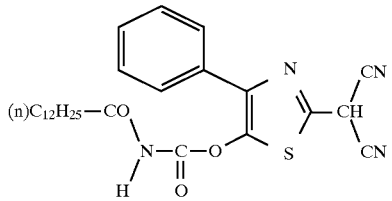
(C-47)
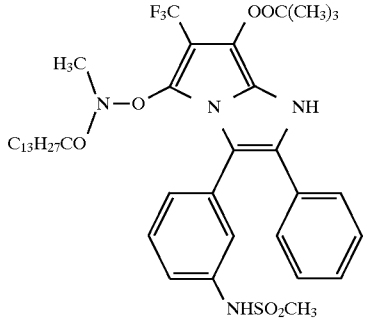
(C-48)
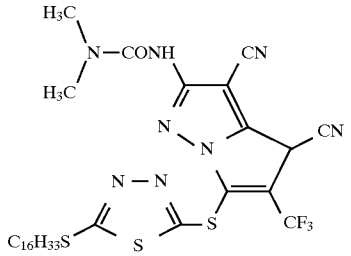
(C-49)
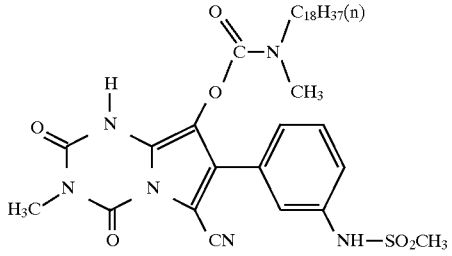

-continued (C-50)

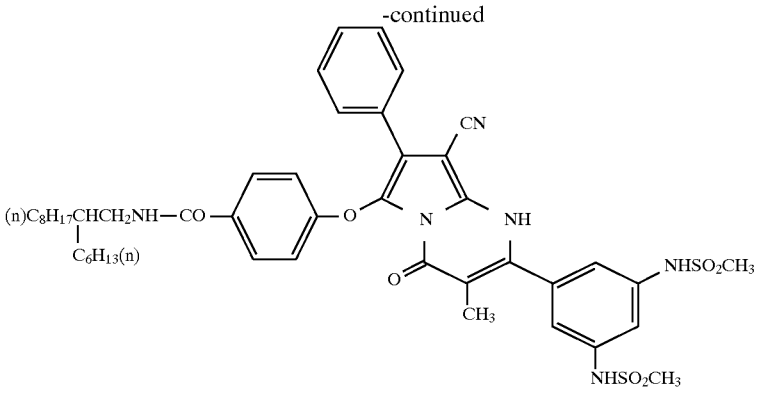

The reducing agent for color formation according to the present invention is preferably used in an amount of 0.01 mmol/m$^2$ to 10 mmol/m$^2$ in one color-forming layer, in order to obtain satisfactory color density. More preferably the amount to be used is 0.05 mmol/m$^2$ to 5 mmol/m$^2$, and particularly preferably 0.1 mmol/m$^2$ to 1 mmol/m$^2$.

A preferable amount of the coupler to be used in the color-forming layer in which the reducing agent for color formation according to the present invention is used, is 0.05 to 20 times, more preferably 0.1 to 10 times, and particularly preferably 0.2 to 5 times, the amount of the reducing agent for color formation in terms of mol.

Now the mordant for use in the present invention will be described. The mordant for use in the present invention may be used in any layer in a light-sensitive material, and it is preferably used in a layer that does not contain the reducing agent for color formation for use in the present invention, since the stability of the reducing agent for color formation is deteriorated if the mordant is added to a layer containing the reducing agent for color formation. Further, a dye formed from the reducing agent for color formation and the coupler diffuses in the gelation membrane swollen during treatment, and is dyed with the mordant. Therefore, the shorter a diffusing distance is, the more preferable it is, in order to obtain a good sharpness. Accordingly, the mordant is preferably added to a layer adjacent to the layer containing the reducing agent for color formation. Further, since the dye formed from the reducing agent for color formation for use in the present invention and the coupler for use in the present invention, is a water-soluble dye, it may dissolved out into a treating solution. Accordingly, to prevent this, preferably the layer to which the mordant is added is situated on the same side of the support but opposite to the layer containing the reducing agent for color formation (on the same side of a support, a mordant-containing layer is situated more remote from the support than a layer containing the reducing agent for color formation). In a case wherein a barrier layer, as described in JP-A No. 168335/1995, is provided to the opposite side of the support relative to the layer to which the mordant is added (on the same side of a support, the barrier layer is situated more remote from the support than the mordant-containing layer), also preferably the layer to which the mordant is added is situated nearer to the support relative to the layer containing the reducing agent for color formation.

Further, the mordant for use in the present invention may be added to multiple layers, and, particularly when multiple layers contain the reducing agent for color formation, it is also preferred to add the mordant to each of adjacent layers.

The mordant that can be used in the present invention, can be selected optionally from mordants that are usually used in the photographic light-sensitive material and that can fix the diffusive dye. Among them, a polymer mordant is particularly preferred. Examples of the polymer mordant include a polymer having a tertialy amino group, a polymer having a nitrogen-containing heterocyclic portion, and a polymer having a quarternary cationic group thereof.

Preferred examples of homopolymers or copolymers containing vinyl monomer units having the tertiary amino group include the following. Numerical values for the monomer units represent mol % (the same meaning is also applied to hereinafter).

Examples of homopolymers or copolymers containing vinyl monomer units having a tertiary imidazole group include the following, also including mordants as described, for example, in U.S. Pat. Nos. 4,282,305, 4,115,124, and 3,148,061, and JP-A Nos. 118834/1985, 122941/1985, 244043/1987, and 244036/1987.

P-4

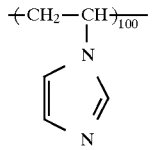

P-5

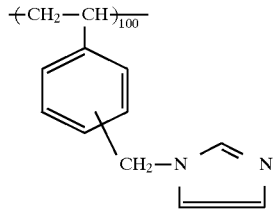

P-6

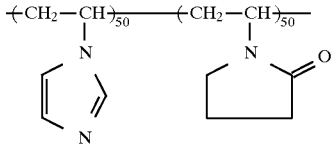

P-7

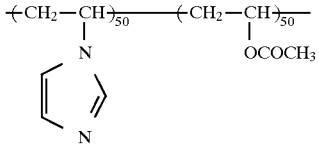

-continued

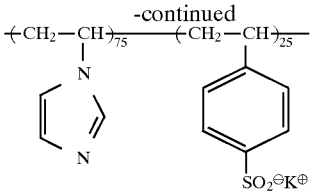

P-8

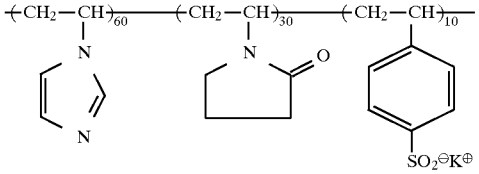

P-9

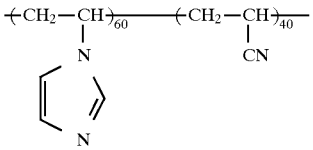

P-10

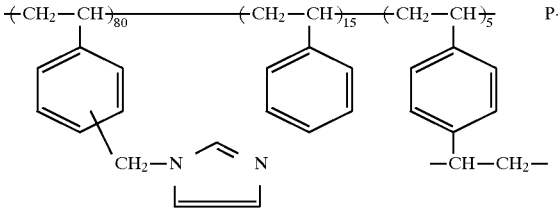

P-11

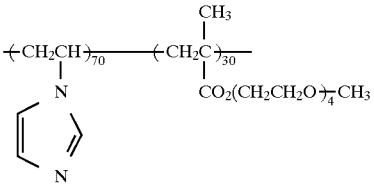

P-12

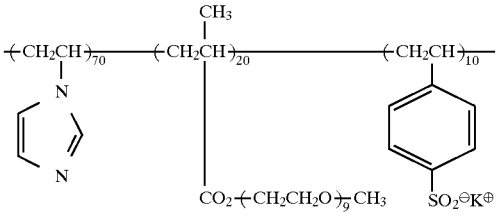

P-13

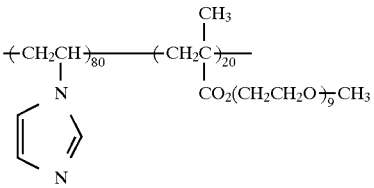

P-14

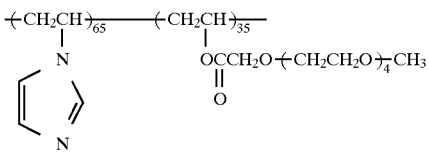

P-15

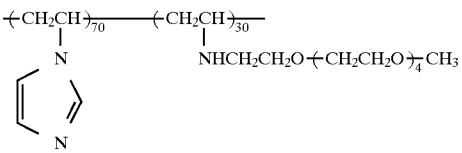

P-16

-continued

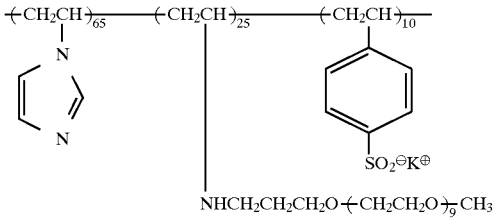

P-17

Preferred examples of homopolymers or copolymers containing vinyl monomer units having a quarternary imidazolium salt include the following, also including mordants as described, for example, in British Patent Nos. 2,056,101, 2,093,041, and 1,594,961, U.S. Pat. Nos. 4,124,386, 4,115,124, and 4,450,224, and JP-A No. 28325/1973.

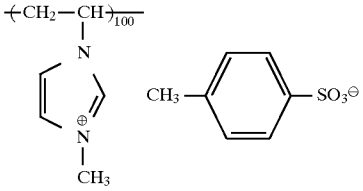

P-18

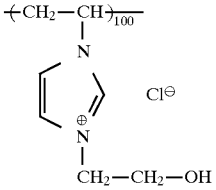

P-19

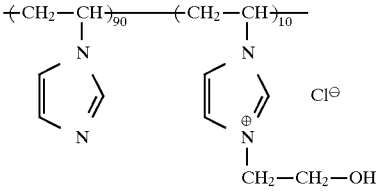

P-20

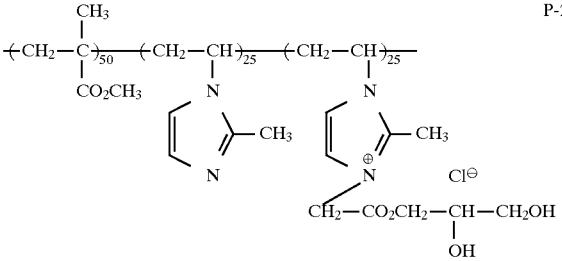

P-21

In addition to the above, preferred examples of homopolymers and copolymers containing vinyl monomer units having a quarternary ammonium salt include the following, also including mordants as described, for example, in U.S. Pat. Nos. 3,709,690, 3,898,088, and 3,958,995, and JP-A Nos. 57836/1985, 60643/1985, 122940/1985, 122942/1985, and 235134/1985.

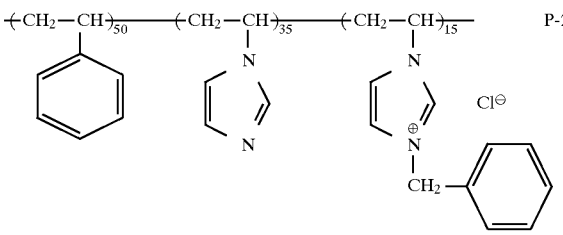

P-22

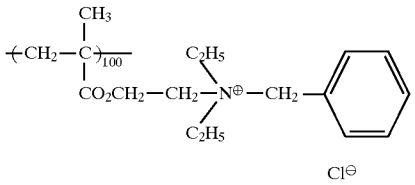

P-23

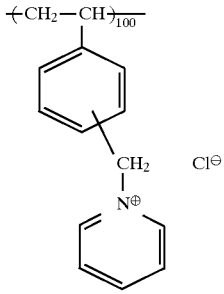

P-24

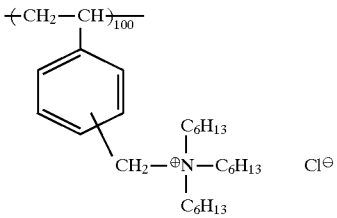

P-25

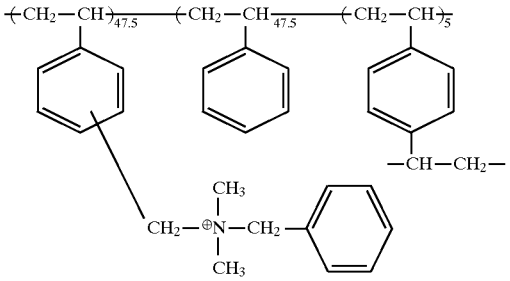

P-26

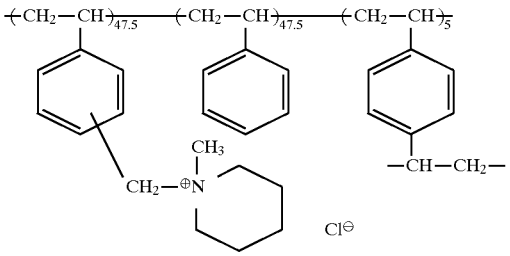

P-27

-continued

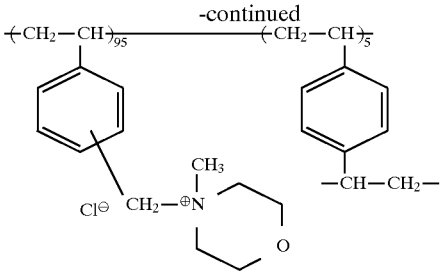

P-28

In addition, there can be mentioned vinyl pyridine polymers and vinyl pyridinium cation polymers as disclosed, for example, in the specifications of U.S. Pat. Nos. 2,548,564, 2,484,430, 3,148,161, and 3,756,814; polymer mordants capable of crosslinking with gelatin or the like, as disclosed, for example, in the specifications of U.S. Pat. Nos. 3,625, 694, 3,859,096, and 4,128,538, and British Patent No. 1,277,453; aqueous sol-type mordants as disclosed in U.S. Pat. Nos. 3,958,995, 2,721,852, and 2,798,063, and JP-A Nos. 115228/1979, 145529/1979, and 26027/1979; water-insoluble mordants as disclosed in the specification of U.S. Pat. No. 3,898,088; reactive mordants capable of forming covalent bonds with a dye, as disclosed in the specification of U.S. Pat. No. 4,168,976 (JP-A No. 137333/1979); and, further, those mordants as disclosed in the specifications of U.S. Pat. Nos. 3,709,690, 3,788,855, 3,642,482, 3,488,706, 3,557,066, and 3,271,147, and JP-A Nos. 71332/1975, 30328/1978, 155528/1977, 125/1978, and 1024/1978.

In addition, there can also be mentioned mordants as described in the specifications of U.S. Pat. Nos. 2,675,316 and 2,882,156.

The molecular weight of the polymer mordants for use in the present invention is appropriately 1,000 or more but 1,000,000 or below, and particularly preferably 10,000 or more but 200,000 or below.

The polymer mordant described above can be used usually as an admixture with a hydrophilic colloid. As the hydrophilic colloid, gelatin and/or highly hygroscopic synthetic polymer can be used, with gelatin being most typical. The mixing ratio between the polymer mordant and the hydrophilic colloid and the coating amount of the polymer mordant can be determined with ease by those skilled in the art, in accordance with the amount of dye to be mordanted, the kind and the composition of the polymer mordant, and the process used for forming an image. The mordant/hydrophilic colloid ratio is generally 20/80 or more but 80/20 or below (weight ratio), and the coating amount of the mordant is appropriately 0.2 $g/m^2$ or more but 15 $g/m^2$ or below, and more preferably it is used in an amount 0.5 $g/m^2$ or more but 8 $g/m^2$ or below.

If the reducing agent for color formation for use in the present invention is dispersed in an oleophilic high boiling organic solvent, the redox reaction with the silver halide cannot be conducted directly. Accordingly, for forming a color image from the image-wise-exposed silver halide, it is necessary to use a compound having a function of cross oxidation between the silver halide and the reducing agent for color formation (hereinafter referred to as an auxiliary developing agent). Such a compound may be added to a treating solution, as described later, but preferably the compound is not contained in the treating solution, in view of safety and the handleability of the treating solution, and accordingly it is preferable to incorporate the compound in the light-sensitive material.

An auxiliary developing agent and a precursor thereof used in the light-sensitive material of the present invention are explained below.

The auxiliary developing agent used in the present invention is a compound that can develop silver halide particles exposed to light, and the oxidized product of the compound can oxidize a reducing agent for color formation (hereinafter referred to as cross oxidation).

As the auxiliary developing agent for use in the present invention, pyrazolidones, dihydroxybenzenes, reductones, or aminophenols can be used preferably, with pyrazolidones being used particularly preferably. Preferably that the diffusibility in a hydrophilic colloidal layer is low, and, for example, the solubility to water (25° C.) is preferably 0.1% or below, more preferably 0.05% or below, and particularly preferably 0.01% or below.

The precursor of the auxiliary developing agent used in the present invention is a compound that is present stably in the light-sensitive material, but it rapidly releases the auxiliary developing agent after it has been treated by a treating solution. Also in a case of using the compound, preferably the diffusibility in the hydrophilic colloidal layer is low. For example, the solubility to water (25° C.) is preferably 0.1% or below, more preferably 0.05% or below, and particularly preferably 0.01% or below. There is no particular restriction on the solubility of the auxiliary developing agent released from the precursor, but preferably the solubility of the auxiliary developing agent itself is low.

The precursor for the auxiliary developing agent for use in the present invention is preferably represented by formula (A), and the auxiliary developing agent is preferably represented by formula (B-1) or (B-2).

Formula (B-1)

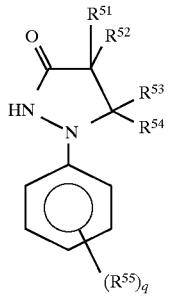

Formula (B-2)

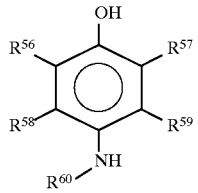

Formula (A)

A—(L)n-PUG

A represents a blocking group whose bond to (L)n-PUG will be split off at the time of development processing, L represents a linking group that splits from the bonding between L and PUG, after splitting of the bond between L and A in the formula (A); n represents an integer of 0 to 3, and PUG represents an auxiliary developing agent.

Groups represented in formula (A) will now be described.

As the blocking group represented by A, the following already known groups can be used: blocking groups described, for example, in JP-B ("JP-B means examined Japanese patent publication) No. 9968/1973, JP-A Nos. 8828/1977 and 82834/1982, U.S. Pat. No. 3,311,476, and JP-B No. 44805/1972 (U.S. Pat. No. 3,615,617), such as an acyl group and a sulfonyl group; blocking groups that use the reverse Michael reaction, as described, for example, in JP-B Nos. 17369/1980 (U.S. Pat. No. 3,888,677), 9696/1980 (U.S. Pat. No. 3,791,830), and 34927/1980 (U.S. Pat. No. 4,009,029), and JP-A Nos. 77842/1981 (U.S. Pat. No. 4,307,175), 105640/1984, 105641/1984, and 105642/1984; blocking groups that use the formation of quinone methide or a compound similar to quinone methide, by intramolecular electron transfer, as described, for example, in JP-B No. 39727/1979, U.S. Pat. Nos. 3,674,478, 3,932,480, and 3,993,661, and JP-A Nos. 135944/1982, 135,945/1982 (U.S. Pat. No. 4,420,554), 136640/1982, 196239/1986, 196240/1986 (U.S. Pat. No. 4,702,999), 185743/1986, 124941/1986 (U.S. Pat. No. 4,639,408), and 280140/1990; blocking groups that use intramolecular nucleophilic replacement reaction, as described, for example, in U.S. Pat. Nos. 4,358,525 and 4,330,617, and JP-A Nos. 53330/1980 (U.S. Pat. No. 4,310,612), 121328/1984, 218439/1984, and 318555/1988 (European Publication Patent No. 0295729); blocking groups that use ring cleavage of a 5-membered ring or 6-membered ring, as described, for example, in JP-A Nos. 76541/1982 (U.S. Pat. No. 4,335,200), 135949/1982 (U.S. Pat. No. 4,350,752), 179842/1982, 137945/1984, 140445/1984, 219741/1984, 202459/1984, 41034/1985 (U.S. Pat. No. 4,618,563), 59945/1987 (U.S. Pat. No. 4,888,268), 65039/1987 (U.S. Pat. No. 4,772,537), 80647/1987, 236047/1991, and 238445/1991; blocking groups that use the addition reaction of a nucleophilic reagent to a conjugated unsaturated bond, as described, for example, in JP-A Nos. 201057/1984 (U.S. Pat. No. 4,518,685), 95346/1986 (U.S. Pat. No. 4,690,885), 95347/1986 (U.S. Pat. No. 4,892,811), 7035/1989, 42650/1989 (U.S. Pat. No. 5,066,573), 245255/1989, 207249/1990, 235055/1990 (U.S. Pat. No. 5,118,596), and 186344/1992; blocking groups that use the β-elimination reaction, as described, for example, in JP-A Nos. 93442/1984, 32839/1986, and 163051/1987, and JP-B No. 37299/1993; blocking groups that use the nucleophilic replacement reaction of diarylmethanes, as described in JP-A No. 188540/1986; blocking groups that uses the Lossen rearrangement reaction, as described in JP-A No 187850/1987; blocking groups that use the reaction between the N-acylated product of thiazolidin-2-thion and amines, as described in JP-A Nos. 80646/1987, 144163/1987, and 147457/1987; and blocking groups that have two nucleophilic groups to react with two nucleophilic agents, as described in JP-A Nos. 296240/1990 (U.S. Pat. No. 5,019,492), 177243/1992, 177244/1992, 177245/1992, 177246/1992, 177247/1992, 177248/1992, 177249/1992, 179948/1992, 184337/1992, and 184338/1992, International Publication Patent No. 92/21064, JP-A No. 330438/1992, International Publication Patent No. 93/03419, and JP-A No. 45816/1993, as well as JP-A Nos. 236047/1991 and 238445/1991.

The group represented by L in the compound represented by formula (A) may be any linking group that can be split off from the group represented by A, at the time of development processing, and that then can split $(L)_{n-1}$-PUG. Examples are groups that use the split of a hemi-acetal ring, as described in U.S. Pat. Nos. 4,146,396, 4,652,516, and 4,698,297; timing groups that bring about an intramolecular nucleophilic substitution reaction, as described in U.S. Pat. Nos. 4,248,962, 4,847,185, or 4,857,440; timing groups that use an electron transfer reaction to bring about a cleavage reaction, as described in U.S. Pat. No. 4,409,323 or 4,421,845; groups that use the hydrolysis reaction of an iminoketal to bring about a cleavage reaction, as described in U.S. Pat.

No. 4,546,073; groups that use the hydrolysis reaction of an ester to bring about a cleavage reaction, as described in West German Publication Patent No. 2,626,317; or groups that use a reaction with sulfite ions to bring about a cleavage reaction, as described in European Patent No. 0572084.

PUG in formula (A) will now be described.

In the present invention, preferably the auxiliary developing agent is a compound capable of releasing electrons according to the Kendall-Pelz rule, which compound is represented preferably by formula (B-1) or (B-2), more preferably by formula (B-1).

In formulae (B-1) and (B-2), $R^{51}$ to $R^{54}$ each represent a hydrogen atom, an alkyl group, a cycloalkyl group, an alkenyl group, an aryl group, or a heterocyclic group.

$R^{55}$ to $R^{59}$ each represent a hydrogen atom, a halogen atom, a cyano group, an alkyl group, a cycloalkyl group, an alkenyl group, an aryl group, a heterocyclic group, an alkoxy group, a cycloalkyloxy group, an aryloxy group, a heterocyclic oxy group, a silyloxy group, an acyloxy group, an amino group, an anilino group, a heterocyclicamino group, an alkylthio group, an arylthio group, a heterocyclicthio group, a silyl group, a hydroxyl group, a nitro group, an alkoxycarbonyloxy group, a cycloalkyloxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, a cycloalkyloxycarbonyl group, an aryloxycarbonyl group, a carbamoyl group, a carbonamido group, a ureido group, an imido group, an alkoxycarbonylamino group, an aryloxycarbonylamino group, a sulfonamido group, a sulfamoylamino group, an alkylsulfinyl group, an arenesulfinyl group, an alkanesulfonyl group, an arenesulfonyl group, a sulfamoyl group, a sulfo group, a phosphinoyl group, or a phosphinoylamino group.

q is an integer of 0 to 5, and when q is 2 or more, $R^{55}$'s may be different. $R^{60}$ represents an alkyl group or an aryl group.

When the auxiliary developing agent represented by formula (B-1) or (B-2) corresponds to PUG of formula (A), the bonding position is at the oxygen atom or nitrogen atom of the auxiliary developing agent.

Compounds represented by formula (A), (B-1) or (B-2) are shown specifically below, but the auxiliary developing agent or its precursor used in the present invention is not limited to these specific examples.

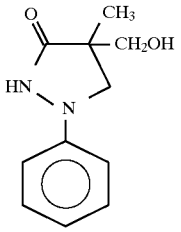

(ETA-1)

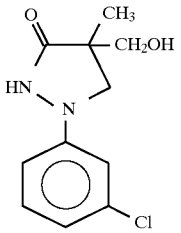

(ETA-2)

-continued

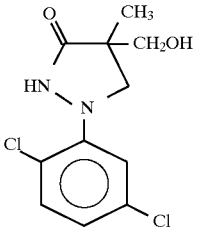

(ETA-3)

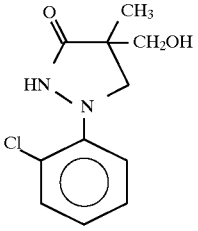

(ETA-4)

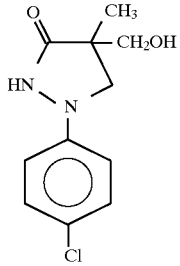

(ETA-5)

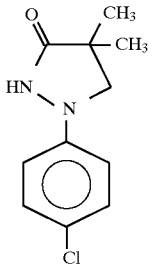

(ETA-6)

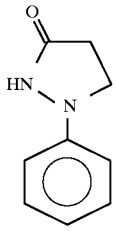

(ETA-7)

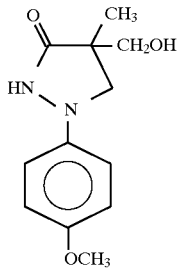

(ETA-8)

-continued
(ETA-9)
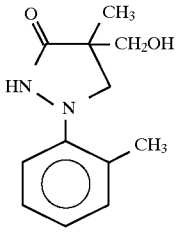
(ETA-10)
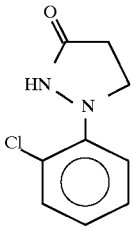
(ETA-11)
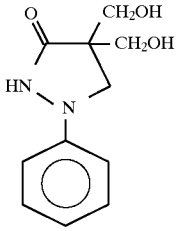
(ETA-12)
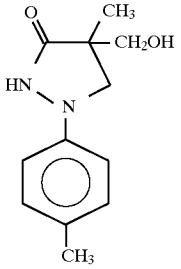
(ETA-13)
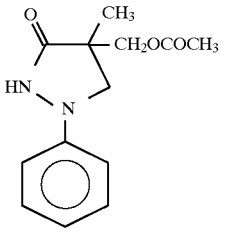
(ETA-14)
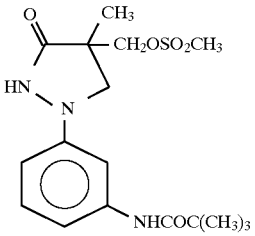
-continued
(ETA-15)
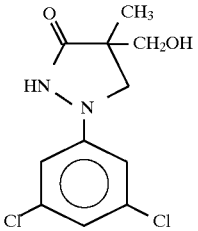
(ETA-16)
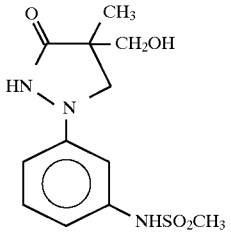
(ETA-17)
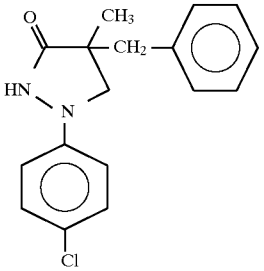
(ETA-18)
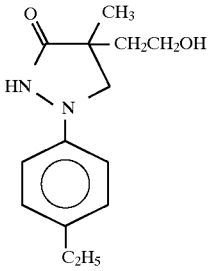
(ETA-19)
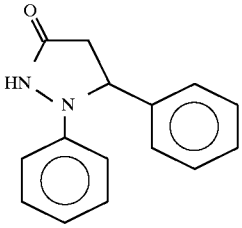
(ETA-20)
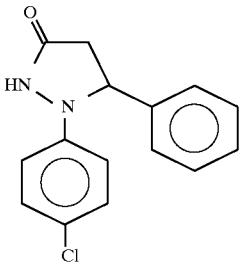

-continued
(ETA-21)
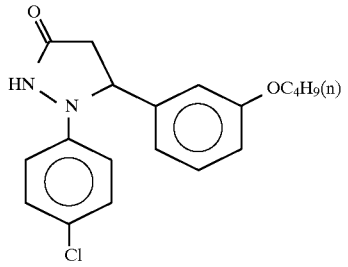
(ETA-22)
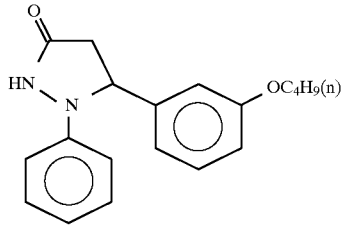
(ETA-23)
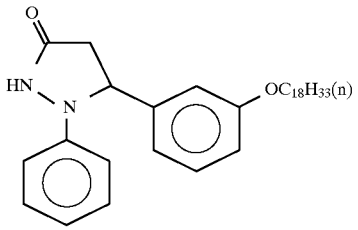
(ETA-24)
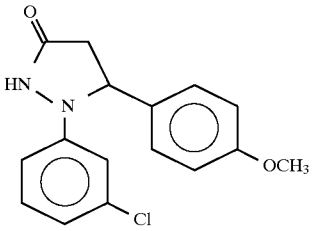
(ETA-25)
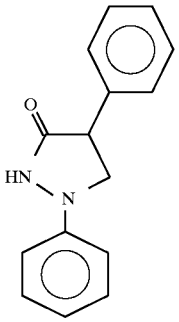
(ETA-26)
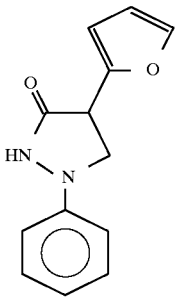
-continued
(ETA-27)
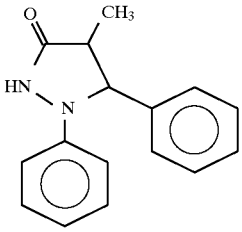
(ETA-28)
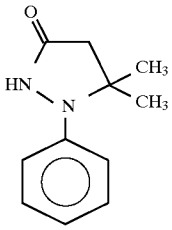
(ETA-29)
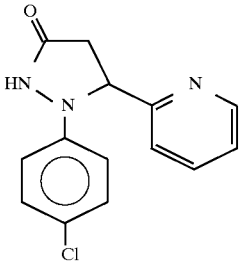
(ETA-30)
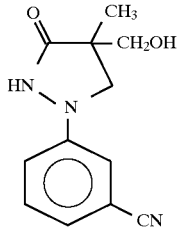
(ETA-31)
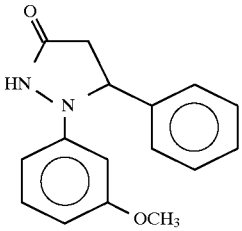
(ETA-32)
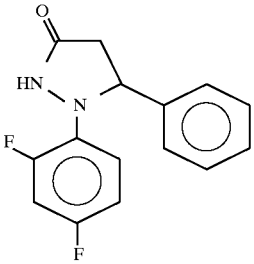

-continued (ETA-33)

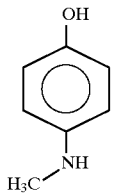

(ETA-34)

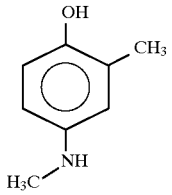

(ETA-35)

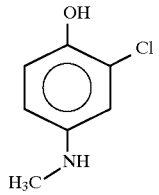

(ETA-36)

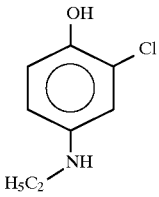

(ETA-37)

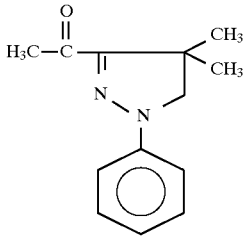

(ETA-38)

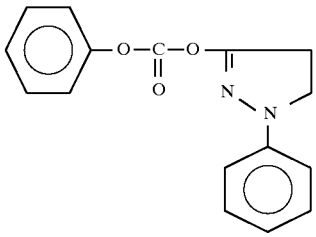

(ETA-39)

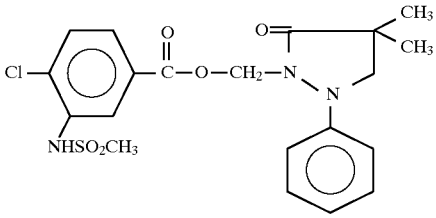

-continued (ETA-40)

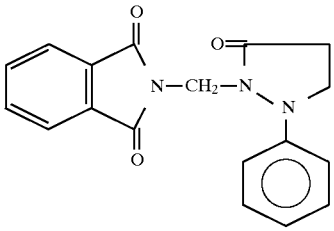

(ETA-41)

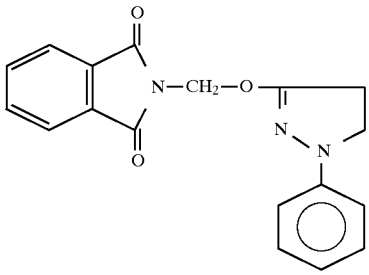

(ETA-42)

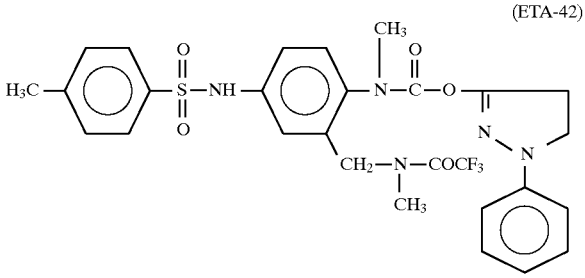

(ETA-43)

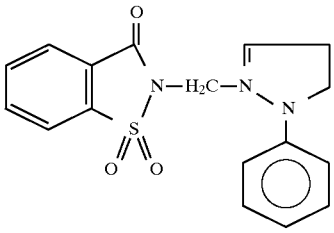

The above compound may be added to any of the light-sensitive layer, an intermediate layer, an undercoat layer, and a protective layer of a light-sensitive material, and preferably it is added to and used in a non-light-sensitive layer when an auxiliary developing agent is contained in the light-sensitive material.

The methods of incorporating the compound into the light-sensitive material include, for example, a method of dissolving the compound in a water-miscible organic solvent, such as methanol, and directly adding this to a coating solution; a method of forming a solution or a colloidal dispersion of the compound, with a surface-active agent also included, and adding the same to a coating solution; a method of dissolving the compound into a solvent or oil substantially immiscible with water, and then dispersing the solution into water or a hydrophilic colloid, and then adding the same to a coating solution; or a method of adding the compound, in a state of a dispersion of fine solid particles, to a coating solution. The known methods described above may be applied singly or in combination.

The addition amount of the compound to the light sensitive material is generally 1 mol % to 200 mol %, preferably 5 mol % to 100 mol %, and more preferably 10 mol % to 50 mol %, based on the reducing agent for color formation.

The color light-sensitive material of the present invention basically comprises photographic constitutional layers including at least one hydrophilic colloidal layer coated on a support, and the light-sensitive silver halide, the dye-forming coupler (the coupler for forming a dye), the reducing agent for color formation, the mordant, and the like are contained in one or more photographic constituent layers.

The dye-forming coupler and the reducing agent for color formation used in the present invention are added to an identical layer, in the most typical embodiment, but they can be added divisionally into separate layers, as long as they can react with each other. These ingredients are preferably added to a silver halide emulsion layer or a layer adjacent therewith in the light-sensitive material, and particularly preferably they are added together to an identical silver halide emulsion layer. In this embodiment, both of the compounds are preferably co-emulsified in a high boiling organic solvent.

Examples of the high boiling organic solvent that can be used in the present invention are described, for example, in U.S. Pat. No. 2,322,027. High boiling organic solvents having a boiling point at a normal pressure of 160° C. or higher, particularly 175° C. or higher, are preferred, and examples of them include, for example, phthalic acid esters [e.g. dibutyl phthalate, dicyclohexyl phthalate, di-2-ethylhexyl phthalate, decyl phthalate, bis(2,4-di-tert-aminophenyl) phthalate, bis(2,4-di-tert-amyl-phenyl) isophthalate, and bis(1,1-diethylpropyl) phthalate]; phosphoric acid aryl esters (e.g. triphenyl phosphate and tricresyl phosphate); benzoic acid esters (e.g. 2-ethylhexyl benzoate, dodecyl benzoate, and 2-ethylhexyl-p-hydroxybenzoate); sulfonamides (e.g. N-butylbenzenesulfonamide); alcohols or phenols (e.g. isostearyl alcohol and 2,4-di-tert-amylphenol); aliphatic carboxylic acid ester (e.g. bis(2-ethylhexyl) sebacate, dioctyl azelate, glycerol tributylate, isostearyl lactate, and trioctyl citrate); hydrocarbons (e.g. paraffin, dodecylbenzene, and diisopropylnaphthalene); and chlorinated paraffins. Further, as an auxiliary solvent, organic solvents having a boiling point of 30° C. or higher, preferably 50° C. or higher, and lower than about 160° C., can be used, and typical examples thereof include, for example, ethyl acetate, butyl acetate, ethyl propyonate, methyl ethyl ketone, cyclohexanone, 2-ethoxyethyl acetate, and dimethylformamide. The usage amount of the high boiling organic solvent that can be used in the present invention can be changed depending on the purpose, with no particular restriction. The solvent is preferably used in an amount in the range of 0.01 to 20, more preferably 0.01 to 10, and further preferably 0.02 to 5, by weight ratio to the reducing agent for color formation to be used.

The preferable means of placing the reducing agent for color formation and the dye-forming coupler to be used in the present invention contained in any one of photographic constitutional layers, is that these compounds are dissolved in the high-boiling-point organic solvent (if necessary, used in combination with the above auxiliary solvent); the solution is finely emulsified and dispersed in a hydrophilic colloid; and the resulting emulsified dispersion (in admixture with a silver halide emulsion as a preferred embodiment) is coated on a support.

To emulsify and disperse the compounds to be used in the present invention, a known polymer dispersion method may be used. Namely, specific examples of the steps and the effects of the latex dispersion method, which is a polymer dispersion method, and specific examples of latexes for impregnation, are described, for example, in U.S. Pat. No. 4,199,363, West German Patent Application (OLS) Nos. 2,541,274 and 2,541,230, JP-B No. 41091/1978, and European Patent Laid-Open Publication No. 029104; and the dispersion method using a polymer that is insoluble in water but soluble in an organic solvent, is described in PCT International Laid-Open Publication No. WO 88/00723. The latter dispersion method is preferably.

The average particle size of the lipophilic fine particles containing the reducing agent for color formation according to the present invention is not particularly limited, and the average particle size is preferably 0.05 to 0.3 $\mu$m, and more preferably 0.05 to 0.2 $\mu$m, in view of the color-forming property.

Making the average particle size of the lipophilic fine particles small is generally attained, for example, by selecting an appropriate type of surface-active agent; by increasing the amount of a surface-active agent to be used; by increasing the viscosity of the hydrophilic colloid solution; by lowering the viscosity of the lipophilic organic layer by, for example, the combined use of a low-boiling-point organic solvent; by increasing the shearing force, for example, by intensifying the rotation of the stirring blades of an emulsifying apparatus; by prolonging the emulsifying period.

The particle size of lipophilic fine particles can be measured, for example, by such an apparatus as a Nanosizer (trade name; manufactured by British Coulter Co.).

As the support to be used in the present invention, any support can be used if it is a transmissible support or a reflective support on which a photographic emulsion layer can be coated, such as glass, paper, and plastic film.

As the plastic film to be used in the present invention, for example, polyester films made, for example, of polyethylene terephthalates, polyethylene naphthalates, cellulose triacetate, or cellulose nitrate; polyamide films, polycarbonate films, and polystyrene films can be used.

"The reflective support" that can be used in the present invention refers to a support that increases the reflecting properties to make bright the dye image formed in the silver halide emulsion layer, and such a reflective support includes a support coated with a hydrophilic resin containing a light-reflecting substance, such as titanium oxide, zinc oxide, calcium carbonate, and calcium sulfate, dispersed therein, or a support made of a hydrophilic resin itself containing a dispersed light-reflecting substance. Examples are a polyethylene-coated paper, a polyester-coated paper, a polypropylene-series synthetic paper, a support having a reflective layer or using a reflecting substance, such as a glass sheet; a polyester film made, for example, of a polyethylene terephthalate, cellulose triacetate, or cellulose nitrate; a polyamide film, a polycarbonate film, a polystyrene film, and a vinyl chloride resin. As the polyester-coated paper, particularly a polyester-coated paper whose major component is a polyethylene terephthalate, as described in European Patent EP 0,507,489, is preferably used.

The reflective support to be used in the present invention is preferably a paper support, both surfaces of which are coated with a water-resistant resin layer, and at least one of the water-resistant resin layers contains fine particles of a white pigment. Preferably the particles of a white pigment are contained in a density of 12% by weight or more, and more preferably 14% by weight or more. Preferably the light-reflecting white pigment is kneaded well in the presence of a surface-active agent, and the surface of the pigment particles is preferably treated with a dihydric to tetrehydric alcohol.

In the present invention, a support having the second kind diffuse reflective surface can also be used, preferably. "the second kind diffuse reflectivity" means diffuse reflectivity obtained by making a specular surface uneven, to form finely divided specular surfaces facing different directions, which finely divided surfaces, specular surfaces, are dispersed in their directions. The unevenness of the second kind diffuse reflective surface has a three-dimensional average coarseness of generally 0.1 to 2 μm, and preferably 0.1 to 1.2 μm, for the center surface. Details about such a support are described in JP-A No. 239244/1990.

In order to obtain colors ranging widely on the chromaticity diagram by using three primary colors: yellow, magenta, and cyan, use is made of a combination of at least three silver halide emulsion layers photosensitive to respectively different spectral regions. For examples, a combination of three layers of a blue-sensitive layer, a green-sensitive layer, and a red-sensitive layer, and a combination of a green-sensitive layer, a red-sensitive layer, and an infrared-sensitive layer, and the like can be coated on the above support. The photosensitive layers can be arranged in various orders known generally for color light-sensitive materials. Further, each of these light-sensitive layers can be divided into two or more layers if necessary.

In the light-sensitive material, photographic constitutional layers comprising the above photosensitive layers and various auxiliary layers, such as a protective layer, an underlayer, an intermediate layer, an antihalation layer, and a backing layer, can be provided. Further, in order to improve the color separation, various filter dyes can be added to the photographic constitutional layer.

The silver halide grains used in the present invention are made of silver bromide, silver chloride, silver iodide, silver chlorobromide, silver chloroiodide, silver iodobromide, or silver chloroiodobromide. Other silver salts, such as silver rhodanate, silver sulfide, silver selenide, silver carbonate, silver phosphate, or a silver salt of an organic acid, may be contained in the form of independent grains or as part of silver halide grains. If it is desired to make the development/desilvering (bleaching, fixing, and bleach-fix) step rapid, silver chlorobromide grains or silver chloride grains having a high silver chloride content (preferably 95 mol % or more) are desirable. Further, if the development is to be restrained moderately, it is preferable to contain silver iodide. The preferable silver iodide content varies depending on the intended light-sensitive material. For example, in the case of X-ray photographic materials, the preferable silver iodide content is in the range of 0.1 to 15 mol %, and in the case of graphic art and micro photographic materials, the preferable silver iodide content is in the range of 0.1 to 5 mol %. In the case of photographic materials represented by color negatives, preferably silver halide contains 1 to 30 mol %, more preferably 5 to 20 mol %, and particularly preferably 8 to 15 mol %, of silver iodide. It is preferable to incorporate silver chloride in silver iodobromide grains, because the lattice strain can be made less intense. For a reflect-type light-sensitive material that is necessary to be rapidly processed, the silver iodide content is preferably 0, or 1 mol % or below.

In the silver halide grains used in the present invention, in accordance with the purpose, any of regular crystals having no twin plane, and those described in "Shashin Kogyo no Kiso, Ginen Shashin-hen", edited by Nihon Shashin-gakkai (Corona Co.), page 163, such as single twins having one twin plane, parallel multiple twins having two or more parallel twin planes, and nonparallel multiple twins having two or more nonparallel twin planes, can be chosen and used. An example in which grains different in shape are mixed is disclosed in U.S. Pat. No. 4,865,964, and if necessary this method can be chosen. In the case of regular crystals, cubes having (100) planes, octahedrons having (111) planes, and dodecahedral grains having (110) planes, as disclosed in JP-B No. 42737/1980 and JP-A No. 222842/1985, can be used. Further, (h11) plane grains represented by (211), (hh1) plane grains represented by (331), (hk0) plane grains represented by (210) planes, and (hk1) plane grains represented by (321) planes, as reported in "Journal of Imaging Science", Vol. 30, page 247 (1986), can be chosen and used in accordance with the purpose, although the preparation is required to be adjusted. Grains having two or more planes in one grain, such as tetradecahedral grains having (100) and (111) planes in one grain, grains having (100) and (110) planes in one grain, or grains having (111) and (110) planes in one grain, can be chosen and used in accordance with the purpose.

The value obtained by dividing the diameter of the projected area, which is assumed to be a circle, by the thickness of the grain, is called an aspect ratio, which defines the shape of tabular grains. Tabular grains having an aspect ratio of 1 or more can be used in the present invention. Tabular grains can be prepared by methods described, for example, by Cleav in "Photography Theory and Practice" (1930), page 131; by Gutof in "Photographic Science and Engineering", Vol. 14, pages 248 to 257 (1970); and in U.S. Pat. Nos. 4,434,226, 4,414,310, 4,433,048, and 4,439,520, and British Patent No. 2,112,157. When tabular grains are used, such merits are obtained that the covering power is increased and the color sensitization efficiency due to a sensitizing dye is increased, as described in detail in the above-mentioned U.S. Pat. No. 4,434,226. The average aspect ratio of 80% or more of all the projected areas of grains is desirably 1 or more but less than 100, more preferably 2 or more but less than 20, and particularly preferably 3 or more but less than 10. As the shape of tabular grains, a triangle, a hexagon, a circle, and the like can be chosen. A regular hexagonal shape having six approximately equal sides, described in U.S. Pat. No. 4,798,354, is a preferable mode.

In many cases, the grain size of tabular grains is expressed by the diameter of the projected area assumed to be a circle, and grains having an average diameter of 0.6 microns or below, as described in U.S. Pat. No. 4,748,106, are preferable, because the quality of the image is made high. An emulsion having a narrow grain size distribution, as described in U.S. Pat. No. 4,775,617, is also preferable. It is preferable to restrict the shape of tabular grains so that the thickness of the grains may be 0.5 microns or below, and more preferably 0.3 microns or below, because the sharpness is increased. Further, an emulsion in which the grains are highly uniform in thickness, with the deviation coefficient of grain thickness being 30% or below, is also preferable. Grains in which the thickness of the grains and the plane distance between twin planes are defined, as described in JP-A No. 163451/1988, are also preferable.

In the case of tabular grains, the dislocation lines can be observed by a transmission electron microscope. In accordance with the purpose, it is preferable to choose grains having no dislocation lines, grains having several dislocation lines, or grains having many dislocation lines. Dislocation introduced straight in a specific direction in the crystal orientation of grains, or curved dislocation, can be chosen, and it is possible to choose from, for example, dislocation introduced throughout grains, dislocation introduced in a particular part of grains, and dislocation introduced limitedly, for example, to the fringes of grains. In addition to the case of introduction of dislocation lines into tabular grains, also preferable is the case of introduction of dislocation lines into regular crystalline grains or irregular grains, represented by potato grains. In this case, a preferable mode is that introduction is limited to a particular part of grains, such as vertexes and edges.

The silver halide emulsion used in the present invention may be subjected to a treatment for making grains round, as disclosed, for example, in European Patent Nos. 96,727B1 and 64,412B1, or it may be improved in the surface, as disclosed in West Germany Patent No. 2,306,447C2 and JP-A No. 221320/1985.

Generally, the grain surface has a flat structure, but it is also preferable in some cases to make the grain surface uneven intentionally. Examples are a technique in which part of crystals, for example, vertexes and the centers of planes, are formed with holes, as described in JP-A Nos. 106532/1983 and 221320/1985, and ruffled grains, as described in U.S. Pat. No. 4,643,966.

The grain size of the emulsion used in the present invention is evaluated, for example, by the diameter of the projected area equivalent to a circle using an electron microscope; by the diameter of the grain volume equivalent to a sphere, calculated from the projected area and the grain thickness; or by the diameter of a volume equivalent to a sphere, using the Coulter Counter method. A selection can be made from ultrafine grains having a sphere-equivalent diameter of 0.05 microns or below, and coarse grains having a sphere-equivalent diameter of 10 microns or more. Preferably grains of 0.1 microns or more but 3 microns or less are used as photosensitive silver halide grains.

As the emulsion used in the present invention, an emulsion having a wide grain size distribution, that is, a so-called polydisperse emulsion, or an emulsion having a narrow grain size distribution, that is, a so-called monodisperse emulsion, can be chosen and used in accordance with the purpose. As the scale for representing the size distribution, the deviation coefficient of the diameter of the projected area of the grain equivalent to a circle, or the deviation coefficient of the sphere-equivalent diameters of the volume, can be used. If a monodisperse emulsion is used, it is good to use an emulsion having such a size distribution that the deviation coefficient is 25% or below, more preferably 20% or below, and further more preferably 15% or below.

Further, in order to allow the light-sensitive material to satisfy the intended gradation, in an emulsion layer having substantially the same color sensitivity, two or more monodisperse silver halide emulsions different in grain size are mixed and applied to the same layer or are applied as overlaid layers. Further, two or more polydisperse silver halide emulsions can be used as a mixture; or they can be used to form overlaid layers; or a combination of a monodisperse emulsion and a polydisperse emulsion can be used as a mixture; or the combination can be used to form overlaid layers.

The photographic emulsion used in the present invention can be prepared by a method described, for example, by P. Glafkides in "Chemie et Phisique Photographique," Paul Montel, 1967; by G. F. Duffin in "Photographic Emulsion Chemistry," Focal Press, 1966; or by V. L. Zelikman et al. in "Making and Coating Photographic Emulsion," Focal Press, 1964. That is, any of the acid process, the neutral process, the ammonia process, and the like can be used; and to react a soluble silver salt with a soluble halogen salt, any of the single-jet method, the double-jet method, a combination thereof, and the like can be used. A method wherein grains are formed in the presence of excess silver ions (the so-called reverse precipitation process) can also be used. As one type of the double-jet method, a method wherein pAg in the liquid phase, in which a silver halide will be formed, is kept constant, that is, the so-called controlled double-jet method, can also be used. According to this method, a silver halide emulsion wherein the crystals are regular in shape and whose grain size is approximately uniform, can be obtained.

When the emulsion according to the present invention is prepared, in accordance with the purpose, it is preferable to allow a salt of a metal ion to be present, for example, at the time when grains are formed, in the step of desalting, at the time when the chemical sensitization is carried out, or before the application. When the grains are doped, the addition is preferably carried out at the time when the grains are formed; or after the formation of the grains, but before the completion of the chemical sensitization, when the surface of the grains is modified or when the salt of a metal ion is used as a chemical sensitizer. As to the doping of grains, selection can be made from a case in which the whole grains are doped, one in which only the core parts of the grains are doped, one in which only the shell parts of the grains are doped, one in which only the epitaxial parts of the grains are doped, and one in which only the substrate grains are doped. For example, Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi can be used. These metals can be added if they are in the form of a salt that is soluble at the time when grains are formed, such as an ammonium salt, an acetate, a nitrate, a sulfate, a phosphate, a hydroxide, a six-coordinate complex, and a four-coordinate complex. Examples include $CdBr_2$, $CdCl_2$, $Cd(NO_3)_2$, $Pd(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. As a ligand of the coordination compound, one can be selected from a halogen, $H_2O$, a cyano group, a cyanate group, a thiocyanate group, a nitrosyl group, a thionitrosyl group, an oxo group, and a carbonyl group. With respect to these metal compounds, only one can be used, but two or more can also be used in combination.

In some cases, a method wherein a chalcogen compound is added during the preparation of the emulsion, as described in U.S. Pat. No. 3,772,031, is also useful. In addition to S, Se, and Te, a cyanate, a thiocyanate, a selenocyanate, a carbonate, a phosphate, or an acetate may be present.

The silver halide grains according to the present invention can be subjected to at least one of sulfur sensitization, selenium sensitization, tellurium sensitization (these three are called chalcogen sensitization, collectively), noble metal sensitization, and reduction sensitization, in any step of the production for the silver halide emulsion. A combination of two or more sensitizations is preferable. Various types of emulsions can be produced, depending on the steps in which the chemical sensitization is carried out. There are a type wherein chemical sensitizing nuclei are embedded in grains, a type wherein chemical sensitizing nuclei are embedded at parts near the surface of grains, and a type wherein chemical sensitizing nuclei are formed on the surface. In the emulsion according to the present invention, the location at which chemical sensitizing nuclei are situated can be selected in accordance with the purpose, and generally preferably at least one type of chemical sensitizing nucleus is formed near the surface.

Chemical sensitizations that can be carried out preferably in the present invention are chalcogen sensitization and noble metal sensitization, which may be used singly or in combination; and the chemical sensitization can be carried out by using active gelatin, as described by T. H. James in "The Theory of the Photographic Process," 4th edition, Macmillan, 1997, pages 67 to 76, or by using sulfur, selenium, tellurium, gold, platinum, palladium, or iridium, or a combination of these sensitizing agents, at a pAg of 5 to 10, a pH of 5 to 8, and a temperature of 30° to 80° C., as described in Research Disclosure, Item 12008 (April 1974); Research Disclosure, Item 13452 (June 1975); Research Disclosure, Item 307105 (November 1989); U.S. Pat. Nos. 2,642,361, 3,297,446, 3,772,031, 3,857,711, 3,901,714, 4,266,018, and 3,904,415, and British Patent No. 1,315,755.

In the photographic emulsion used in the present invention, various compounds can be incorporated for the purpose of preventing fogging during the process of the production of the light-sensitive material, during the storage of the light-sensitive material, or during the photographic processing, or for the purpose of stabilizing the photographic performance. That is, compounds known as antifoggants or stabilizers can be added, such as thiazoles including benzothiazolium salts, nitroimidazoles, nitrobenzimidazoles, chlorobenzimidazoles, bromobenzimidazoles, mercaptothiazoles, mercaptobenzothiazoles,amircaptobenzimidazoles, mercaptothiadiazoles, aminotriazoles, benzotriazoles, nitrobenzotriazoles, mercaptotetrazoles (particularly 1-phenyl-5-mercaptotetrazole, 1-(5-methylureidophenyl)-5-mercaptotetrazole, 1-(5-acetylaminophenyl)-5-mercaptotetrazole and the like); mercaptopyrimidines; mercaptotriazines; thioketo compounds, such as oxazolinthione; and azaindenes, such as triazaindenes; tetraazaindenes (particularly 4-hydroxy-6-methyl-1,3,3a,7-tetraazaindenes), and pentaazaindenes. For examples, those described in U.S. Pat. Nos. 3,954,474 and 3,982,947, and JP-B No. 28660/1987, can be used. A preferable compound is a compound described in JP-A No. 212932/1988. In accordance with the purpose, the antifoggant and the stabilizer can be added at various times, for example, before the formation of the grains, during the formation of the grains, after the formation of the grains, in the step of washing with water, at the time of dispersion after the washing with water, before the chemical sensitization, during the chemical sensitization, after the chemical sensitization, and before the application. In addition to the case wherein the antifoggant and the stabilizer are added during the preparation of the emulsion, so that the antifogging effect and the stabilizing effect, which are their essential effects, may be achieved, they can be used for various other purposes, for example, for controlling the habit of the crystals, for making the grain size small, for reducing the solubility of the grains, for controlling the chemical sensitization, and for controlling the arrangement of the dyes.

In order to exhibit the effect of the present invention, the photographic emulsion used in the present invention is preferably spectrally-sensitized by methin dyes or other dyes. Dyes that can be used include a cyanine dye, a merocyanine dye, a composite cyanin dye, a composite merocyanine dye, a halopolar cyanine dye, a hemicyanine dye, a styryl dye, and a hemioxonol dye. Particularly useful dyes are those belonging to a cyanine dye, a merocyanine dye, and a composite merocyanine dye. In these dyes, any of nuclei generally used in cyanine dyes as a basic heterocyclic nuclei can be applied. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus; and a nucleus formed by fusing an cycloaliphatic hydrocarbon ring or an aromatic hydrocarbon ring to these nuclei, such as an indolenine nucleus, a benzindolenine nucleus, an indole nucleus, a benzoxazole nucleus, a naphthooxazole nucleus, a benzothiazole nucleus, a naphthothiazole nucleus, a benzoselenazole nucleus, a benzimidazole nucleus, and a quinoline nucleus, can be applied. These nuclei may be substituted on the carbon atom.

In the merocyanine dye or the composite merocyanine dye, as a nucleus having a ketomethylene structure, a 5- to 6-membered heterocyclic nucleus, such as a pyrazolin-5-one nucleus, a thiohydantoine nucleus, a 2-thiooxazolidin-2,4-dione nucleus, a thiazolidin-2,4-dione nucleus, a rhodanine nucleus, and a thiobarbituric acid nucleus, can be applied.

Further, as the red-sensitive spectrally sensitizing dye of silver halide emulsion grains high in silver chloride content, red-sensitive spectrally sensitizing dyes described in JP-A No. 123340/1991 are quite preferable, in view of the stability, the powerfulness of the absorption, the dependency of exposure on temperature, etc.

In the light-sensitive material of the present invention, if the infrared region is to be spectrally sensitized efficiently, sensitizing dyes described in JP-A No. 15049/1991 (the left upper column, page 12, to the left lower column, page 21), JP-A No. 20730/1991 (the left lower column, page 4, to the left lower column, page 15), EP-0,420,011 (page 4, line 21, to page 6, line 54), EP-0,420,012 (page 4, line 12, to page 10, line 33), EP-0,443,466, and U.S. Pat. No. 4,975,362 are preferably used.

The time at which the sensitizing dye is added to the emulsion may be at any stage for preparing the emulsion that is known to be useful. Most generally, although the addition of the sensitizing dye is carried out at a time after the completion of chemical sensitization and before the coating, the sensitizing dye may be added together with a chemical sensitizer simultaneously, to carry out the spectral sensitization and the chemical sensitization at the same time, as described in U.S. Pat. Nos. 3,628,969 and 4,225,666; or the sensitizing dye may be added before the chemical sensitization, as described in JP-A No. 113,928/1983; or the sensitizing dye may be added before the completion of the formation of the silver halide grain precipitation, to start the spectral sensitization. Further, as taught in U.S. Pat. No. 4,225,666, the above compounds may be added in portions; that is, it is possible that part of these compounds is added before the chemical sensitization, with the remaining part added after the chemical sensitization; thus they may be added at any time during the formation of silver halide grains, for example, as shown in a method disclosed in U.S. Pat. No. 4,183,756.

In the present invention, in combination with the water-soluble dye, a colored layer that can be decolored by processing can be used. The colored layer to be used that can be decolored by processing may be directly adjacent to the emulsion layer, or it may be arranged to be adjacent to the emulsion layer through an intermediate layer containing a processing color-mixing inhibitor, such as gelatin and hydroquinone. Preferably the colored layer is arranged below (on the side of the support) an emulsion layer that will form the same primary color as the color of the colored layer. All or some of colored layers corresponding to respective primary colors may be arranged. Also, colored layer corresponding to primary color regions may be arranged. The optical reflection density of the colored layer is preferably such that the optical density value at the wavelength having the highest optical density in the wavelength region used for exposure (the visible light region of from 400 nm to 700 nm, in the case of usual printer exposure, and the wavelength of the scanning exposure light source to be used, in the case of scanning exposure) is 0.2 or more, but 3.0 or less, more preferably 0.5 or more, but 2.5 or less, and particularly preferably 0.8 or more, but 2.0 or less.

To form the colored layer, conventionally known methods can be applied in combination. For example, use can be made of a method wherein dyes described in JP-A No. 282244/1990 (page 3, the right upper column, to page 8), or dyes described in JP-A No. 7931/1991 (page 3, the right upper column, to page 11, the left lower column), are made into a solid fine particle dispersion state and are contained in a hydrophilic colloid layer; a method wherein a cationic polymer is mordanted with an anionic dye; a method wherein a dye is adsorbed to fine particles, for example, of a silver halide, and is fixed in a layer; and a method, as described in JP-A No. 239544/1989, wherein colloidal silver is used. One method wherein a fine powder of a dye is dispersed in the solid state is described in JP-A No. 308244/1990 (pages 4 to 13); in the method, for example, a fine powder dye, which is substantially insoluble in water, at least at a pH of 6 or below, but which is substantially soluble in water, at least at a pH of 8 or over, is contained. Further, a method wherein a cation polymer is mordanted with an anionic dye is described in JP-A No. 84637/1990 (pages 18 to 26). Methods of the preparation of colloidal silver as a light absorber are described in U.S. Pat. Nos. 2,688,601 and 3,459,563. Among these methods, one in which a fine powder dye is contained, and one in which colloidal silver is used, are preferable.

As a binder or a protective colloid that can be used in the light-sensitive material according to the present invention, a gelatin is advantageously used, and other hydrophilic colloids can be used alone or in combination with a gelatin. As the gelatin, a low-calcium gelatin having a calcium content of 800 ppm or less, and more preferably 200 ppm or less, is preferably used. Further, in order to prevent the proliferation of various molds and fungi that will proliferate in a hydrophilic colloid layer, to deteriorate an image, preferably mildew-proofing agents, as described in JP-A No. 271247/1988, are added.

When the light-sensitive material of the present invention is subjected to printer exposure, it is preferable to use a band stop filter described in U.S. Pat. No. 4,880,726, by which light color-mixing is removed, to noticeably improve color reproduction.

Although the above various additives are used in the light-sensitive material in the art, other various additives can also be used, depending on the purpose.

These additives are described in more detail in Research Disclosure Item 17643 (December 1978), Research Disclosure Item 18716 (November 1979), and Research Disclosure Item 307105 (November 1989); and the particular sections are summarized in the Table given below.

| Additive | RD 17643 | RD 18716 | | RD 307105 | |
|---|---|---|---|---|---|
| 1 Chemical sensitizers | p. 23 | p. 648 | (right column) | p. 996 | |
| 2 Sensitivity-enhancing agents | — | p. 648 | (right column) | — | |
| 3 Spectral sensitizers and Supersensitizers | pp. 23–24 | pp. 648–649 | (right column) (right column) | pp. 996–998 | (right column) (right column) |
| 4 Brightening agents | p. 24 | — | | p. 998 | (right column) |
| 5 Antifogging agents and Stabilizers | pp. 24–25 | p. 649 | (right column) | pp. 998–1000 | (right column) (right column) |
| 6 Light absorbers, Filter dyes, and UV Absorbers | pp. 25–26 | pp. 649–650 | (right column) (left column) | p. 1003 | (left to right column) |
| 7 Stain-preventing agents | p. 25 (right column) | p. 650 column) | (left to right | — | |
| 8 Image dye stabilizers | p. 25 | — | | — | |
| 9 Hardeners | p. 26 | p. 651 | (left column) | pp. 1004–1005 | (right column) (left column) |
| 10 Binders | p. 26 | p. 651 | (left column) | pp. 1003–1004 | (right column) (right column) |
| 11 Plasticizers and Lubricants | p. 27 | p. 650 | (right column) | p. 1006 | (left to right column) |
| 12 Coating aids and Surface-active agents | pp. 26–27 | p. 650 | (right column) | pp. 1005–1006 | (left column) (left column) |
| 13 Antistatic agents | p. 27 | p. 650 | (right column) | pp. 1006–1007 | (right column) (left column) |

The light-sensitive material of the present invention is used in a print system using usual negative printers, and also it is preferably used for digital scanning exposure that uses monochromatic high-density light, such as a second harmonic generating light source (SHG) that comprises a combination of a nonlinear optical crystal with a semiconductor laser or a solid state laser using a semiconductor laser as an excitation light source, a gas laser, a light-emitting diode, or a semiconductor laser. To make the system compact and inexpensive, it is preferable to use a semiconductor laser or a second harmonic generating light source (SHG) that comprises a combination of a nonlinear optical crystal with a semiconductor laser or a solid state laser. Particularly, to design an apparatus that is compact, inexpensive, long in life, and high in stability, the use of a semiconductor laser is preferable, and it is desired to use a semiconductor laser for at least one of the exposure light sources.

If such a scanning exposure light source is used, the spectral sensitivity maximum of the light-sensitive material of the present invention can arbitrarily be set by the wavelength of the light source for the scanning exposure to be used. In an SHG light source obtained by combining a nonlinear optical crystal with a semiconductor laser or a solid state laser that uses a semiconductor laser as an excitation light source, since the emitting wavelength of the laser can be halved, blue light and green light can be obtained. Therefore, the spectral sensitivity maximum of the light-sensitive material can be present in each of the usual three regions, the blue region, the green region and the red region. In order to use a semiconductor laser as a light source to make the apparatus inexpensive, high in stability, and compact, preferably each of at least two layers has a spectral sensitivity maximum at 670 nm or over. This is because the emitting wavelength range of the available, inexpensive, and stable III-V group semiconductor laser is present now only in from the red region to the infrared region. However, on the laboratory level, the oscillation of a II-VI group semiconductor laser in the green or blue region is confirmed and it is highly expected that these semiconductor lasers can be used inexpensively and stably if production technique for the semiconductor lasers be developed. In that event, the necessity that each of at least two layers has a spectral sensitivity maximum at 670 nm or over becomes lower.

In such scanning exposure, the time for which the silver halide in the light-sensitive material is exposed is the time for which a certain very small area is required to be exposed. As the very small area, the minimum unit that controls the quantity of light from each digital data is generally used and is called a picture element. Therefore, the exposure time per picture element is changed depending on the size of the picture element. The size of the picture element is dependent on the density of the picture element, and the actual range is from 50 to 2,000 dpi. If the exposure time is defined as the time for which a picture size is exposed with the density of the picture element being 400 dpi, preferably the exposure time is $10^{-4}$ sec or less, more preferably $10^{-6}$ sec or less.

Processing materials and processing methods used in the present invention will now be described in detail. In the present invention, the light-sensitive material is developed (silver development/cross oxidation of the built-in reducing agent), desilvered, washed with water, and stabilized. In some cases, after the washing with water or the stabilizing processing, a treatment of alkalinization for color formation intensification is carried out.

In the present invention, when the auxiliary developing agent is not contained in the light-sensitive material, the auxiliary developing agent is preferably contained in a developing solution, for the reasons described previously. As the auxiliary developing agent added to the developing solution, pyrazolidones, dihydroxybenzenes, reductones, and aminophenols can be used preferably, with pyrazolidones being used particularly preferably.

Among pyrazolidones, 1-phenyl-3-pyrazolidones are preferable, and they include 1-phenyl-3-pyrazolidone, 1-phenyl-4,4-dimethyl-3-pyrazolidone, 1-phenyl-4-methyl-4-hydroxylmethyl-3-pyrazolidone, 1-phenyl-4,4-dihydroxymethyl-3-pyrazolidone, 1-phenyl-5-methyl-3-pyrazolidone, 1-phenyl-5-phenyl-3-pyrazolidone, 1-p-tolyl-4-methyl-4-hydroxymethyl-3-pyrazolidone, 1-p-chlorophenyl-4-methyl-4-hydroxymethyl-3-pyrazolidone, 1-phenyl-2-hydroxymethyl-4,4-dimethyl-3-pyrazolidone, 1-phenyl-2-acetyl-3-pyrazolidone, and 1-phenyl-2-hydroxymethyl-5-phenyl-3-pyrazolidone.

Dihydroxybenzenes include hydroquinone, chlorohydroquinone, bromohydroquinone, isopropylhydroquinone, methylhydroquinone, 2,3-dichlorohydroquinone, 2,5-dichlorohydroquinone, 2,5-dimethylhydroquinone, and potassium hydroquinonemonosulfonate.

Among reductones, ascorbic acid and derivatives thereof are preferable, and preferably compounds described in JP-A No. 148822/1994 on pages 3 to 10, can be used. Particularly, sodium L-ascorbate and sodium erysorbate are preferable.

P-aminophenols include N-methyl-p-aminophenol, N-(β-hydroxyethyl)-p-aminophenol, N-(4-hydroxyphenyl) glycine, 2-methyl-p-aminophenol.

These compounds are generally used alone, but use of two or more of them in combination is also preferable, to enhance the development and cross oxidation activity.

The amount of these compounds to be used in the developing solution is generally $2.5\times10^{-4}$ to 0.2 mol/liter, preferably 0.0025 to 0.1 mol/liter, and more preferably 0.001 to 0.05 mol/liter.

The present invention, when the auxiliary developing agent, for example pyrazolidones, is built in the light-sensitive material as described previously, preferably the auxiliary developing agent is not contained in the developing solution. That is, it is preferable to apply a treatment using an alkali solution that does not contain any auxiliary developing agent.

The developing solution used in the present invention preferably has a pH of 8 to 13, and more preferably 9 to 12.

To retain the above pH, it is preferable to use various buffers. In the developing solution, an organic preservative, a development accelerator, an antisettling agent, a fluorescent whitening agent, and the like which have been known hitherto, can be added.

The processing temperature of the developing solution to be applied to the present invention is generally 20° to 50° C., and preferably 30° to 45° C. The processing time is generally 5 sec to 2 min, and preferably 10 sec to 1 min. With respect to the replenishing rate, a small amount is preferable, and the replenishing rate is generally 15 to 600 ml, preferably 25 to 200 ml, and more preferably 35 to 100 ml, per $m^2$ of the light-sensitive material.

After the development, a desilvering process is generally carried out. The desilvering process comprises a fixing process, or both bleaching process and a fixing process. When both bleaching and fixing are carried out, the bleaching process and the fixing process may be carried out separately or simultaneously (bleach-fixing process). Also, according to the purpose, the processing may be carried out in a bleach-fixing bath having two successive tanks; or the fixing process may be carried out before the bleach-fixing process; or the bleaching process may be carried out after the bleach-fixing process. As these bleaching bath and fixing bath, those known hitherto can be used.

It is preferable to carry out the stabilizing process, to stabilize silver salts and dye images, without carrying out the desilvering process after the development.

After the development, a process for intensifying image (intensification) that uses peroxides, halorous acids, iodoso compounds, and cobalt(III) complex compounds, described, for example, in West German Patent (OLS) Nos. 1,813,920, 2,044,993, and 2,735,262, and JP-A Nos. 9728/1973, 84240/1974, 102314/1974, 53826/1976, 13336/1977, and 73731/1977, can be carried out. In order to intensify an image further, the above oxidizing agent for the intensification of an image can be added to the above developing solution, so that the development and the image-intensifying can be conducted in one bath simultaneously. Particularly, hydrogen peroxide is preferable, because the amplification rate is high. These image-intensifying methods are a processing method that is preferable in view of environmental conservation, because the amount of silver in the light-sensitive material can be reduced drastically, for example, to make a bleaching process unnecessary and to allow silver (and silver salts) not to be discharged in a stabilizing process or the like.

The processing temperature of the desilvering step is generally 20° to 50° C., and preferably 30° to 45° C. The processing time is generally 5 sec to 2 min, and preferably 10 sec to 1 min. A small replenishing rate is preferable, and the replenishing rate is generally 15 to 600 ml, preferably 25 to 200 ml, and more preferably 35 to 100 ml, per $m^2$ of the light-sensitive material. The processing is also preferably carried out without replenishment in such a way that the evaporated amount is supplemented with water.

The light-sensitive material of the present invention is generally passed through a washing (rinsing) step after the desilvering process. If a stabilizing process is carried out, the washing step can be omitted. The pH of the washing water and the stabilizing solution is generally 4 to 9, and preferably 5 to 8. The processing temperature is generally 15° to 45° C., and preferably 25° to 40° C. The processing time is generally 5 sec to 2 min, and preferably 10 sec to 40 sec.

The overflow solution associated with the replenishment of the above washing water and/or the stabilizing solution, can be reused in other processes, such as the desilvering process.

The amount of the washing water and/or the stabilizing solution can be set in a wide range depending on various conditions, and the replenishing rate is preferably 15 to 360 ml, and more preferably 25 to 120 ml, per $m^2$ of the light-sensitive material.

The processing time in each process according to the present invention means the time required from the start of the processing of the light-sensitive material at any process, to the start of the processing in the next process. The actual processing time in an automatic developing machine is determined generally by the linear speed and the volume of the processing bath, and in the present invention, as the linear speed, 500 to 4,000 mm/min can be mentioned as a guide. Particularly in the case of a small-sized developing machine, 500 to 2,500 mm/min is preferable.

The processing time in the whole processing steps, that is, the processing time from the developing process to the drying process, is preferably 360 sec or below, more preferably 120 sec or below, and particularly preferably 90 to 30 sec. Herein the processing time means the time from the dipping of the light-sensitive material into the developing solution, till the emergence from the drying part of the processor.

The silver halide color photographic light-sensitive material of the present invention provides excellent effects capable of reducing the amount of processing solutions to be replenished and discharged, and capable of reducing stains after processing caused by long time preservation. Further, according to the image-forming method of the present invention, convenient and rapid processing can be attained while reducing the replenishment and discharging amount of the processing solution.

EXAMPLES

The present invention will now be described specifically with reference to the Examples, but of course the present invention is not limited to them.

Example 1

A paper base, both surfaces of which had been laminated with a polyethylene, was subjected to surface corona discharge treatment; then it was provided with a gelatin undercoat layer containing sodium dodecylbenzensulfonate, and it was coated with three photographic constitutional layers, to produce a photographic printing paper, Sample (100), having the three-layer constitution shown below. The coating solutions were prepared as follows.

First-Layer Coating Solution 17 g of a coupler (ExY), 20 g of a reducing agent for color formation (36), and 80 g of a solvent (Solv-1) were dissolved in ethyl acetate, and the resulting solution was emulsified and dispersed into 16% gelatin aqueous solution containing 10% sodium dodecylbenzensulfonate and citric acid, to prepare an emulsified dispersion A. On the other hand, a silver chlorobromide emulsion A (cubes, a mixture of a large-size emulsion A having an average grain size of 0.88 $\mu$m, and a small-size emulsion A having an average grain size of 0.70 $\mu$m (3:7 in terms of mol of silver), the deviation coefficients of the grain size distributions being 0.08 and 0.10, respectively, and each emulsion having 0.3 mol % of silver bromide locally contained in part of the grain surface whose substrate was made up of silver chloride) was prepared. To the large-size emulsion A of this emulsion, had been added $1.4\times10^{-4}$ mol, per mol of silver, of each of blue-sensitive sensitizing dyes A, B, and C shown below, and to the small-size emulsion A of this emulsion, had been added $1.7\times10^{-4}$ mol, per mol of silver, of each of blue-sensitive sensitizing dyes A, B, and C shown below. The chemical ripening of this emulsion was carried out optimally with a sulfur sensitizer and a gold sensitizer being added. The above emulsified dispersion A and this silver chlorobromide emulsion A were mixed and dissolved, and a first-layer coating solution was prepared so that it would have the composition shown below. The coating amount of the emulsion is in terms of silver.

In the similar way as the method of preparing the first-layer coating solution, coating solutions for the second layer and the third layer were prepared.

As the gelatin hardener for each layer, 1-oxy-3,5-dichloro-s-triazine sodium salt was used.

Further, to each layer, were added Cpd-2, Cpd-3, Cpd-4, and Cpd-5, so that the total amounts would be 15.0 mg/$m^2$, 60.0 mg/$m^2$, 50.0 mg/$m^2$, and 10.0 mg/$m^2$, respectively.

For the silver chlorobromide emulsion of the first layer, the following spectral sensitizing dye was used.

Sensitizing dye A

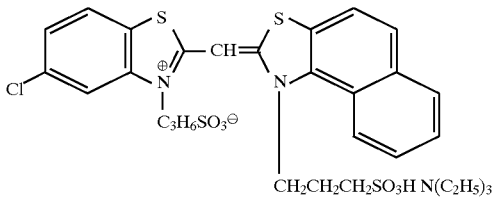

Sensitizing dye B

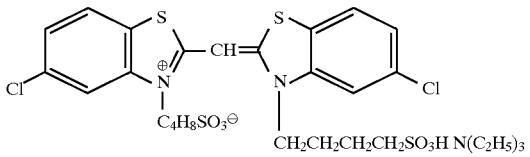

Sensitizing dye C

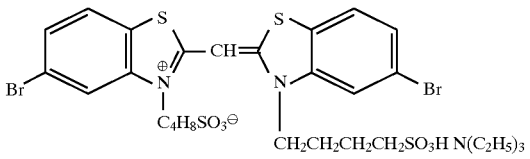

Further, 1-(5-methylureidophenyl)-5-mercaptotetrazol was added to the first-layer in amount of $3.0\times10^{-3}$ mol per mol of the silver halide.

Layer Constitution

The composition of each layer is shown below. The numbers show coating amounts (g/$m^2$). In the case of the silver halide emulsion, the coating amount is in terms of silver.

| | |
|---|---|
| Base | |
| Polyethylene-Laminated Paper | |
| [The polyethylene on the first layer side contained a white pigment ($TiO_2$ 14% by weight) and a blue dye (ultramarine)] | |
| First Layer | |
| The above silver chlorobromide emulsion A | 0.20 |
| Gelatin | 1.50 |
| Yellow coupler (ExY) | 0.17 |
| Reducing agent for color formation (36) | 0.20 |
| Solvent (Solv-1) | 0.80 |
| Second Layer | |
| Gelatin | 3.17 |
| Third Layer (protective layer) | |
| Gelatin | 1.01 |
| Acryl-modified copolymer of polyvinyl alcohol (modification degree: 17%) | 0.04 |
| Liquid paraffin | 0.02 |
| Surface-active agent (Cpd-1) | 0.01 |

Samples (101) to (105) were prepared using the same procedures used for the preparation of Sample (100), except for replacing each of the yellow coupler and the reducing agent for color formation in the coating solution of the first layer, respectively, with an equimolar amount of each of the yellow coupler and the reducing agent for color formation shown in Table 1, and except for adding the mordant, shown in Table 1, in the coating solution of the second layer, such that the mordant would be coated by 3.21 g per $m^2$.

Further, Samples (200) to (205) were prepared using the same procedures used for the preparation of Sample (100), except for replacing a silver chlorobromide emulsion A in the coating solution of the first layer with a silver chlorobromide emulsion B, shown below, in the same amount of silver, and except for replacing each of the coupler and the reducing agent for color formation, respectively, with an equimolar amount of each of the magenta couplers and the reducing agent for color formation shown in Table 2, and except for adding a mordant, shown in Table 2, in the coating solution of the second layer, such that the mordant would be coated by 3.21 g per $m^2$.

A silver chlorobromide emulsion B: cubes, a mixture of a large-size emulsion B having an average grain size of 0.55 $\mu$m, and a small-size emulsion B having an average grain size of 0.39 $\mu$m (1:3 in terms of mol of silver). The deviation coefficients of the grain size distributions were 0.10 and 0.08, respectively, and each emulsion had 0.8 mol % of AgBr locally contained in part of the grain surface whose substrate was made up of silver chloride.

For the silver chlorobromide emulsion B, the following spectrally sensitizing dyes were used:

Sensitizing dye D

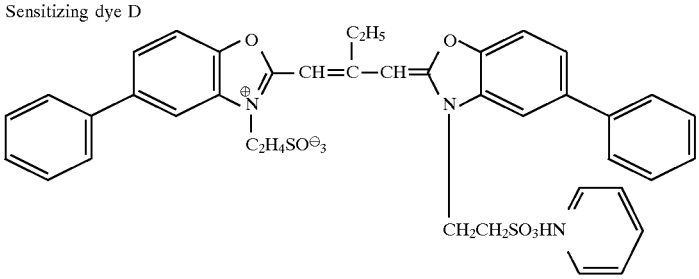

Sensitizing dye E

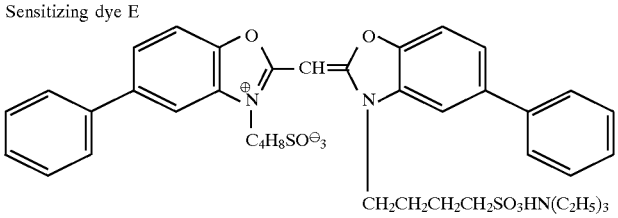

Sensitizing dye F

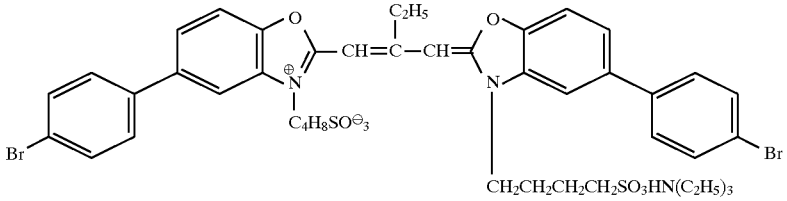

(The sensitizing dye D was added to the large-size emulsion in an amount of $3.0\times10^{-4}$ mol per mol of the silver halide, and to the small-size emulsion in an amount of $3.6\times10^{-4}$ mol per mol of the silver halide; the sensitizing dye E was added to the large-size emulsion in an amount of $4.0\times10^{-5}$ mol per mol of the silver halide, and to the small-size emulsion in an amount of $7.0\times10^{-5}$ mol per mol of the silver halide; and the sensitizing dye F was added to the large-size emulsion in an amount of $2.0\times10^{-4}$ mol per mol of the silver halide, and to the small-size emulsion in an amount of $2.8\times10^{-4}$ mol per mol of the silver halide.)

Further, Samples (300) to (305) were prepared in the same manner as Sample (100), except that, in the coating solution of the first layer, the silver chlorobromide emulsion A was changed to the following silver chlorobromide emulsion C, in the same amount of silver, and that the coupler and the reducing agent for color formation were changed to the cyan couplers and the reducing agents for color formation, shown in Table 3, in the same molar amounts, respectively, and that the mordant shown in Table 3 was added into the coating solution of the second layer, such that the mordant would be coated by 3.21 g per $m^2$.

A silver chlorobromide emulsion C: cubes, a mixture of a large-size emulsion C having an average grain size of 0.5 μm, and a small-size emulsion having an average grain size of 0.41 μm (1:4 in terms of mol of silver). The deviation coefficients of the grain size distributions were 0.09 and 0.11, respectively, and each emulsion had 0.8 mol % of AgBr locally contained in part of the grain surface whose substrate was made up of silver chloride.

For the silver chlorobromide C, the following spectrally sensitizing dyes were used:

Sensitizing dye G

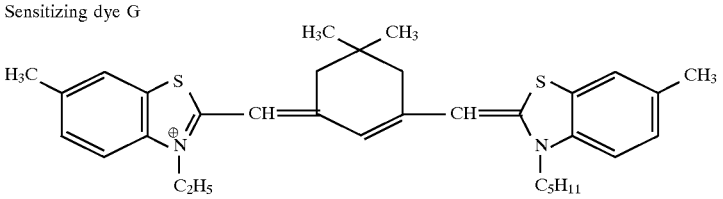

Sensitizing dye H

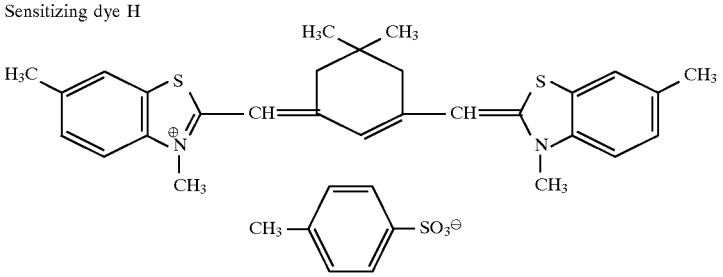

(Each was added to the large-size emulsion in an amount of $5.0\times10^{-5}$ mol per mol of the silver halide, and to the small-size emulsion in an amount of $8.0\times10^{-5}$ mol per mol of the silver halide.)

The used compounds are shown below.

(ExY)

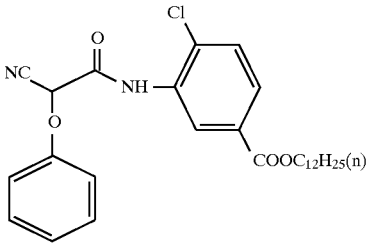

(ExM1)

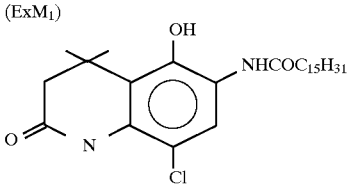

-continued
(ExM$_2$)
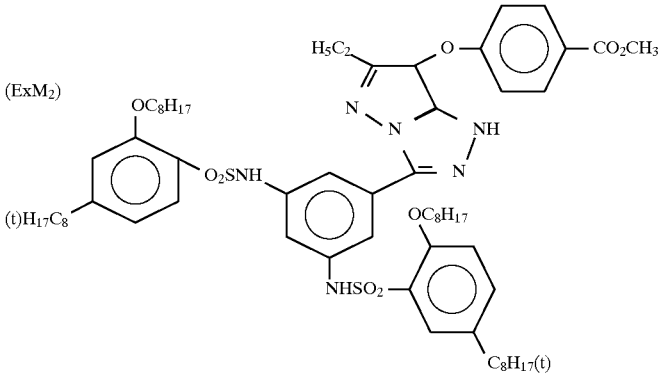
(ExC$_1$)
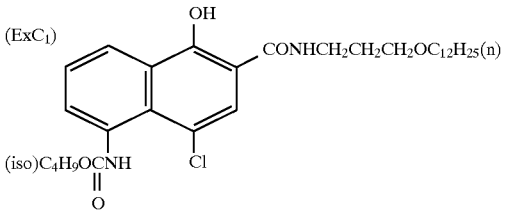
(ExC$_2$)
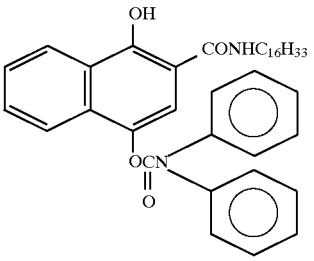
(Cpd-1) Surface-active agent
7:3 mixture (by weight ratio) of
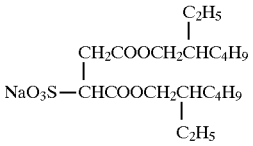
and
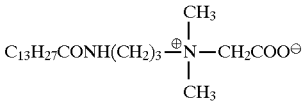
(Cpd-2) Antiseptic
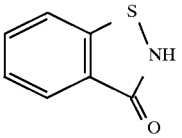

-continued (Cpd-3) Antiseptic

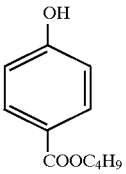

(Cpd-4) Antiseptic
1:1:1:1 mixture of a, b, c, d

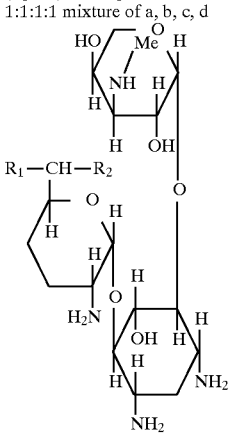

| | $R_1$ | $R_2$ |
|---|---|---|
| a | —Me | —NHMe |
| b | —Me | —$NH_2$ |
| c | —H | —$NH_2$ |
| d | —H | —NHMe |

(Cpd-5) Antiseptic

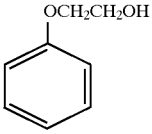

(Solv-1) Solvent

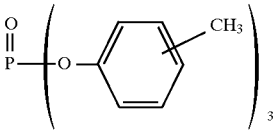

Using an FWH-type sensitometer (color temperature of the light source: 3,200° K), manufactured by Fuji Photo Film Co., Ltd., gradation exposure was given to the thus prepared Samples (100) to (105) through a blue filter for sensitometry, to the thus prepared Samples (200) to (205) through a green filter for sensitometry, and to the thus prepared Samples (300) to (305) through a red filter for sensitometry.

The thus light-exposed Samples were processed with the following processing solutions in the following processing steps 1 or 2.

| Processing step 1<br>Processing step | Temperature | Time |
|---|---|---|
| Development | 40° C. | 15 sec |
| Bleach-fix | 40° C. | 45 sec |
| Rinse | room temperature | 45 sec |
| Alkali treatment | room temperature | 30 sec |

-continued

| Processing step 2<br>Processing step | Temperature | Time |
|---|---|---|
| Development | 40° C. | 15 sec |
| Bleach-fix | 40° C. | 45 sec |
| Rinse | room temperature | 45 sec |

Developing Solution

| | |
|---|---|
| Water | 600 ml |
| Potassium phosphate | 40 g |
| Disodium N,N-bis(sulfonatoethyl)hydroxylamine | 10 g |
| KCl | 5 g |
| Hydroxylethylidene-1,1-diphosphonic acid (30%) | 4 ml |
| 1-Phenyl-4-methyl-4-hydroxymethyl-3-pyrazolidone | 2 g |
| Water to make | 1,000 ml |
| pH (at 25° C. by using potassium hydroxide) | 12 |

Bleach-fix Solution

| | |
|---|---|
| Water | 600 ml |
| Ammonium thiosulfate (700 g/liter) | 93 ml |
| Ammonium sulfite | 40 ml |
| Ethylenediaminetetraacetic acid iron(III) ammonium salt | 55 g |
| Ethylenediaminetetraacetic acid | 2 g |
| Nitric acid (67%) | 30 g |
| Water to make | 1,000 ml |
| pH (at 25° C. by using acetic acid and ammonia water) | 5.8 |

-continued

| Rinsing Solution | |
|---|---|
| Sodium chlorinated isocyanurate | 0.02 g |
| Deionized water (conductivity: 5 μS/cm or below) | 1,000 ml |
| pH | 6.5 |
| **Alkali Treatment Solution** | |
| Water | 800 ml |
| Potassium carbonate | 30 g |
| Water to make | 1,000 ml |
| pH | 10 |

Both for the samples processed in the processing step 1 and the samples processed in the processing step 2, a maximum color density part was measured by blue light for the Samples (100) to (105), by green light for the Samples (200) to (205), and by red light for the Samples (300) to (305). The maximum color density of the sample processed in the processing step 1 is defined as Da(max), and the maximum color density of the sample processed in the processing step 2 is defined as Dn(max). The results are shown in Tables 1, 2, and 3, respectively.

Further, respective two sheets of the samples that had not been exposed to light or processed, were prepared, and they were subjected to desilvering in the above bleach-fixing step. In this process, the alkali treatment was applied to one sheet of a sample, while no alkali treatment was applied to the other sheet of the sample, and both two sheets of each sample were subjected to a compulsory thermo-test at a temperature of 50° C. and humidity of 70% for one week, respectively. After the thermo-test, the density was measured, both for the samples with alkali treatment and samples without alkali treatment, by blue light for the Samples (100) to (105), by green light for the Samples (200) to (205), and by red light for the Samples (300) to (305). The density of the sample with alkali treatment is defined as Da(min), and the density of the sample without alkali treatment is defined as Dn(min). The results are shown in Tables 1, 2, and 3, respectively.

TABLE 1

| Sample No. | Reducing agent for color formation | Yellow coupler | Mordant | With alkali treatment Da(max) | With alkali treatment Da(min) | Without alkali treatment Dn(max) | Without alkali treatment Dn(min) | Remarks |
|---|---|---|---|---|---|---|---|---|
| 100 | (36) | Ex Y | — | 1.88 | 1.80 | 0.48 | 0.12 | Comparative Example |
| 101 | (36) | C-2 | P-27 | 1.92 | 1.90 | 1.82 | 0.11 | This Invention |
| 102 | (1) | Ex Y | — | 1.72 | 1.68 | 0.52 | 0.12 | Comparative Example |
| 103 | (1) | C-2 | P-27 | 1.76 | 1.72 | 1.70 | 0.11 | This Invention |
| 104 | (42) | C-2 | " | 1.70 | 1.68 | 1.65 | 0.11 | This Invention |
| 105 | (52) | C-2 | " | 1.65 | 1.63 | 1.63 | 0.11 | This Invention |

TABLE 2

| Sample No. | Reducing agent for color formation | Magenta coupler | Mordant | With alkali treatment Da(max) | With alkali treatment Da(min) | Without alkali treatment Dn(max) | Without alkali treatment Dn(min) | Remarks |
|---|---|---|---|---|---|---|---|---|
| 200 | (36) | Ex $M_1$ | — | 1.72 | 1.69 | 0.32 | 0.12 | Comparative Example |
| 201 | (36) | C-38 | P-27 | 1.82 | 1.76 | 1.72 | 0.11 | This Invention |
| 202 | (1) | Ex $M_2$ | — | 2.34 | 2.29 | 0.38 | 0.12 | Comparative Example |
| 203 | (1) | C-21 | P-27 | 2.35 | 2.28 | 2.27 | 0.11 | This Invention |
| 204 | (42) | C-38 | " | 1.68 | 1.82 | 1.60 | 0.11 | This Invention |
| 205 | (41) | C-38 | " | 1.55 | 1.50 | 1.50 | 0.11 | This Invention |

TABLE 3

| Sample No. | Reducing agent for color formation | Cyan coupler | Mordant | With alkali treatment Da(max) | With alkali treatment Da(min) | Without alkali treatment Dn(max) | Without alkali treatment Dn(min) | Remarks |
|---|---|---|---|---|---|---|---|---|
| 300 | (36) | Ex $C_1$ | — | 1.46 | 1.40 | 0.13 | 0.08 | Comparative Example |
| 301 | (36) | C-30 | P-27 | 1.58 | 1.52 | 1.54 | 0.08 | This Invention |
| 302 | (1) | Ex $C_2$ | — | 1.49 | 1.43 | 0.16 | 0.08 | Comparative Example |
| 303 | (1) | C-29 | P-27 | 1.62 | 1.56 | 1.58 | 0.08 | This Invention |
| 304 | (42) | C-30 | " | 1.54 | 1.41 | 1.50 | 0.08 | This Invention |
| 305 | (50) | C-30 | " | 1.44 | 1.38 | 1.37 | 0.08 | This Invention |

As is apparent from the results in Tables 1, 2, and 3, samples for which only the reducing agent for color formation and the comparative coupler were used, did not form color unless the alkali treatment was applied. However, when the alkali treatment was applied, the density in the not-exposed part was increased to near the maximum color density, during storage under a wet heat condition. On the contrary, the samples using the reducing agent for color formation, the coupler, and the mordant, according to the present invention, could provide a sufficient color density even without applying an alkali treatment, and the density for the not-exposed part was scarcely increased under the condition of not applying the alkali treatment, showing that satisfactory storability could be obtained.

Example 2

A paper base, both surfaces of which had been laminated with a polyethylene, was subjected to surface corona discharge treatment; then it was provided with a gelatin undercoat layer containing sodium dodecylbenzensulfonate, and it was coated with four photographic constitutional layers, to produce a photographic printing paper, referred to as sample (400), having the four-layer constitution shown below. In the same way as the preparation of the first-layer coating solution of Example 1, a coating solution for the second-layer was prepared.

In the similar way as the method of preparing the second-layer coating solution, coating solutions for the first, third and fourth layer were prepared. As the gelatin hardeners for each layers, 1-oxy-3,5-dichloro-s-triazine sodium salt was used.

Further, to each layer, were added, Cpd-2, Cpd-3, Cpd-4, and Cpd-5 in the same way as Example 1, so that the total amounts would be 15.0 mg/$m^2$, 60.0 mg/$m^2$, 50.0 mg/$m^2$, and 10.0 mg/$m^2$, respectively.

To the second-layer was added 1-(5-methylureidophenyl)-5-mercaptotetrazole in amounts of $3.0\times10^{-3}$ mol, per mol of the silver halide.

Layer Constitution

The composition of each layer is shown below. The numbers show coating amounts (g/$m^2$). In the case of the silver halide emulsion, the coating amount is in terms of silver.

| | |
|---|---|
| Base | |
| Polyethylene-Laminated Paper | |
| [The polyethylene on the first layer side contained a white pigment ($TiO_2$ 14% by weight) and a blue dye (ultramarine)] | |
| First Layer | |
| Gelatin | 1.12 |
| 1,5-diphenyl-3-pyrazolidone | 0.02 |
| Second Layer | |
| The silver chlorobromide emulsion A described in the Example 1 | 0.20 |
| Gelatin | 1.50 |
| Yellow coupler (ExY) | 0.17 |
| Reducing agent for color formation (36) | 0.20 |
| Solvent (Solv-1) | 0.80 |
| Third Layer | |
| Gelatin | 3.17 |
| Fourth Layer (Protective Layer) | |
| Gelatin | 1.01 |
| Acryl-modified copolymer of polyvinyl alcohol (modification degree: 17%) | 0.04 |
| Liquid paraffin | 0.02 |
| Surface-active agent (Cpd-1) | 0.01 |

Samples (401) to (408) were prepared using the same procedures used for the preparation of the Sample (400), except for replacing each of the yellow coupler and the reducing agent for color formation in the coating solution of the second layer with an equimolar amount of each of the yellow coupler and the reducing agent for color formation shown in Table 4, respectively, and except for adding the mordant, shown in Table 4, in the coating solution of the second layer, such that it would be coated by 3.21 g per $m^2$.

In the sample using P-9, as a hardening agent, 1,2-bis(vinylsulfonylacetoamide)ethane was used instead of sodium 1-oxy-3,5-dichloro-s-triazine.

The thus prepared Samples (400) to (408) were given gradation exposure using a blue filter for sensitometry, using an FWH-type sensitometer (color temperature of the light source: 3200° K), manufactured by Fuji Film Co., Ltd.

The samples after the exposure to light were processed by the following processing step 1 or 2 using the developing solution described below, and using the bleach-fixing solution, rinsing solution, and the alkali treatment solution of Example 1.

| Processing step 1<br>Processing step | Temperature | Time |
|---|---|---|
| Development | 40° C. | 15 sec |
| Bleach-fix | 40° C. | 45 sec |
| Rinse | room temperature | 45 sec |
| Alkali treatment | room temperature | 30 sec |

| Processing step 2<br>Processinp step | Temperature | Time |
|---|---|---|
| Development | 40° C. | 15 sec |
| Bleach-fix | 40° C. | 45 sec |
| Rinse | room temperature | 45 sec |

| Developing Solution | |
|---|---|
| Water | 600 ml |
| Potassium phosphate | 40 g |
| KCl | 5 g |
| Hydroxylethylidene-1,1-diphosphonic acid (30%) | 4 ml |
| Water to make | 1,000 ml |
| pH (at 25° C. by using potassium hydroxide) | 12 |

For the Samples (400) to (408), Da(max), Dn(max), Da(min), and Dn(min) were measured by blue light in the same method as in Example 1. The obtained results are shown in Table 4.

TABLE 4

| Sample No. | Reducing agent for color formation | Yellow coupler | Mordant | With alkali treatment Da(max) | With alkali treatment Da(min) | Without alkali treatment Dn(max) | Without alkali treatment Dn(min) | Remarks |
|---|---|---|---|---|---|---|---|---|
| 400 | (36) | Ex Y | — | 2.13 | 2.10 | 0.48 | 0.12 | Comparative Example |
| 401 | (36) | C-2 | P-27 | 2.20 | 2.16 | 2.10 | 0.11 | This Invention |
| 402 | (1) | Ex Y | — | 1.95 | 1.92 | 0.62 | 0.12 | Comparative Example |
| 403 | (1) | C-2 | P-27 | 2.08 | 2.02 | 2.03 | 0.11 | This Invention |
| 404 | (42) | C-2 | " | 2.00 | 1.98 | 1.94 | 0.11 | This Invention |
| 405 | (52) | C-2 | " | 1.93 | 1.90 | 1.90 | 0.11 | This Invention |
| 406 | (36) | C-2 | P-9 | 2.18 | 2.15 | 2.12 | 0.11 | This Invention |
| 407 | (36) | C-2 | P-26 | 2.16 | 2.14 | 2.13 | 0.11 | This Invention |
| 408 | (36) | C-2 | P-22 | 2.13 | 2.10 | 2.09 | 0.11 | This Invention |

As can be seen from the results in Table 4, the color density was increased when 1,5-diphenyl-3-pyrazolidone was built in a photographic printing paper. In addition, similar results as those in Example 1 could be obtained besides those described above.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color photographic light-sensitive material having at least one photographic constitutional layer coated on a support, wherein at least one of the photographic constitutional layers contains at least one reducing agent for color formation represented by formula (I), and at least one coupler for forming a diffusive dye, and the same said at least one photographic constitutional layer or a second layer contains at least one tertiary or quaternary nitrogen mordant; wherein Formula (I) is represented by the formula:

$$Q \qquad C\alpha\text{-}NHNH-Z$$

wherein Cα represents a carbon atom; Z represents a carbamoyl group having at least one hydrogen atom on a nitrogen atom; and Q represents a group of atoms to form, together with the Cα, an unsaturated ring.

2. The silver halide color photographic light-sensitive sensitive material as claimed in claim 1, wherein the unsaturated ring formed with the Cα and Q in formula (I) is a heterocyclic ring.

3. The silver halide color photographic light-sensitive material as claimed in claim 1, wherein the unsaturated ring formed with the Cα and Q in formula (I) is a benzene ring having at least one substituent, and wherein the sum of σ values for the Hammett's substituent constant of the substituents (σp value is used for the substituents on the carbon atom in 1,2 or 1,4 relation with the Cα, while σm value is used for the substituents on the carbon atom in 1,3 relation with the Cα) is 0.8 or more.

4. The silver halide color photographic light-sensitive material as claimed in claim 1, wherein the coupler for forming a diffusive dye has a substituent at the coupling-reactive position.

5. The silver halide color photographic light-sensitive material as claimed in claim 1, wherein the diffusive dye that is formed by coupling the coupler with an oxidized product of the reducing agent for color formation has at least one dissociation group with a pKa of 12 or below.

6. The silver halide color photographic light-sensitive material as claimed in claim 1, wherein the mordant is added to a layer adjacent to a layer containing the reducing agent for color formation.

7. The silver halide color photographic light-sensitive material as claimed in claim 1, wherein the mordant is a polymer mordant.

8. The silver halide color photographic light-sensitive material as claimed in claim 1, comprising at least one auxiliary developing agent or its precursor.

9. An image-forming method, comprising the steps of:

subjecting a silver halide color photographic light-sensitive material to exposure to light image-wise, and developing the silver halide color photographic light-sensitive material with an alkali solution, wherein the silver halide color photographic light-sensitive material has at least one photographic constitutional layer coated on a support, and wherein at least one of the photographic constitutional layers contains at least one reducing agent for color formation represented by formula (I), and at least one coupler for forming a diffusive dye, and the same said at least one photographic constitutional layer or a second layer contains at least one tertiary or quaternary nitrogen mordant; wherein Formula (I) is represented by the formula:

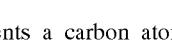

wherein Cα represents a carbon atom; Z represents a carbamoyl group having at least one hydrogen atom on a nitrogen atom; and Q represents a group of atoms to form, together with the Cα, an unsaturated ring.

10. The image-forming method as claimed in claim 9, wherein the unsaturated ring formed with the Cα and Q in formula (I) is a heterocyclic ring.

11. The image-forming method as claimed in claim 9, wherein the unsaturated ring formed with the Cα and Q in formula (I) is a benzene ring having at least one substituent, and wherein the sum of σ value for the Hammett's substituent constant of the substituents (σp value is used for the substituents on the carbon atom in 1,2 or 1,4 relation with the Cα, while σm value is used for the substituents on the carbon atom in 1,3 relation with the Cα) is 0.8 or more.

12. The image-forming method as claimed in claim 9, wherein the coupler for forming a diffusive dye has a substituent at the coupling-reactive position.

13. The image-forming method as claimed in claim 9, wherein the diffusive dye that is formed by coupling the coupler with an oxidized product of the reducing agent for color formation has at least one dissociation group with a pKa of 12 or below.

14. The image-forming method as claimed in claim 9, wherein the mordant is added to a layer adjacent to a layer containing the reducing agent for color formation.

15. The image-forming method as claimed in claim 9, wherein the mordant is a polymer mordant.

16. The image-forming method as claimed in claim 9, wherein the alkali solution is a developing solution that contains substantially no color developing agent.

17. The image-forming method as claimed in claim 9, wherein the alkali solution is a developing solution that contains at least one auxiliary developing agent.

18. The image-forming method as claimed in claim 9, wherein the silver halide color photographic is light-sensitive material comprises at least one auxiliary developing agent.

* * * * *